US008529235B2

(12) United States Patent
Szepesy

(10) Patent No.: US 8,529,235 B2
(45) Date of Patent: Sep. 10, 2013

(54) OSCILLATING VARIABLE DISPLACEMENT RING PUMP

(76) Inventor: Ronald Szepesy, Edmonton (CA)

( * ) Notice: Subject to any disclaimer, the term of this patent is extended or adjusted under 35 U.S.C. 154(b) by 421 days.

(21) Appl. No.: 12/846,134

(22) Filed: Jul. 29, 2010

(65) Prior Publication Data

US 2010/0310403 A1 Dec. 9, 2010

Related U.S. Application Data

(63) Continuation-in-part of application No. 11/818,781, filed on Jun. 15, 2007, now Pat. No. 7,766,636.

(60) Provisional application No. 60/813,810, filed on Jun. 15, 2006.

(51) Int. Cl.
*F03C 4/00* (2006.01)
*F04C 18/00* (2006.01)

(52) U.S. Cl.
USPC ..... 418/248; 418/112; 418/244; 418/249; 418/270

(58) Field of Classification Search
USPC ..... 418/112, 113, 122–124, 243, 248–251, 418/12, 270, 244, 246; 74/22 A, 63, 68, 74/569
See application file for complete search history.

(56) References Cited

U.S. PATENT DOCUMENTS

| | | | | | |
|---|---|---|---|---|---|
| 223,257 | A * | 1/1880 | Sudlow | 418/249 |
| 817,472 | A * | 4/1906 | Decor | 418/249 |
| 1,789,842 | A * | 1/1931 | Rolaff | 418/248 |
| 2,020,987 | A * | 11/1935 | Ayres | 418/249 |
| 2,238,395 | A * | 4/1941 | Nittka | 418/248 |
| 6,827,564 | B2 * | 12/2004 | Becker | 418/249 |
| 7,766,636 | B2 * | 8/2010 | Szepesy | 418/248 |

FOREIGN PATENT DOCUMENTS

| | | | | |
|---|---|---|---|---|
| CH | 193720 | A * | 10/1937 | 418/248 |
| FR | 1341348 | A * | 9/1963 | |
| JP | 58088486 | A * | 5/1983 | 418/249 |

* cited by examiner

*Primary Examiner* — Theresa Trieu
(74) *Attorney, Agent, or Firm* — Parlee McLaws LLP; Jean Macheledt

(57) ABSTRACT

An oscillating variable displacement ring pump provides both positive and variable displacement. A housing circumscribes a pump chamber. The pump chamber encases an oscillating ring driven by a crank assembly. The ring encircles an end of the crank assembly. The crank assembly includes an annular spacer that rolls inside the ring. When the pump chamber is sealed, rotation of the crank assembly causes ring oscillation in the chamber. Ring oscillation creates vacuum pressure, which draws substances into pump chamber via an inlet port while pumping out substances of the pump chamber via an outlet port. A valve within the pump chamber contacts the ring and follows ring oscillation to help separate incoming substances from outgoing substances. The pump can include an adjustable internal by-pass means to control the volume and pressure of substances delivered by the pump.

15 Claims, 26 Drawing Sheets

OSCILLATING VARIABLE DISPLACEMENT RING PUMP

CROSS-REFERENCE TO RELATED APPLICATIONS

This application is a continuation-in-part of U.S. application Ser. No. 11/818,781 filed Jun. 15, 2007, which is incorporated by reference herein in its entirety.

TECHNICAL FIELD

The invention relates to the field of variable displacement pumps. In particular, the invention relates to an oscillating variable displacement ring pump that draws and delivers substances, such as liquids, into and out of a pump chamber by movement of a displacement ring.

BACKGROUND

Displacement pumps can take the form of gear pumps, vane-type pumps and oscillating slide pumps. With these forms of pumps, the volume of substances displaced or delivered is typically fixed due to the physical dimensions of the pumps and cannot be easily varied. It is, therefore, desirable to provide a pump that can be easily changed to vary the amount of substances displaced or delivered.

SUMMARY

An oscillating variable displacement ring pump is provided. In one embodiment, the pump can have a housing circumscribing a pump chamber. The pump chamber includes an inlet port and an outlet port. The pump chamber encases an oscillating variable displacement ring. A valve within the pump chamber contacts the ring to help isolate the outlet port from the inlet port and to separate incoming substances from outgoing substances. The pump draws and delivers substances by movement of the displacement ring within the pump chamber. When the pump chamber is sealed, ring oscillation creates a vacuum on the inlet port and pressure on the outlet port. The vacuum draws substances into the pump chamber through the inlet port while driving substances out of pump chamber through the outlet port.

In one embodiment, a crankshaft rotatably disposed within the pump housing drives ring oscillation. In this embodiment, the crankshaft comprises an input shaft and an offset shaft whereby rotation of input shaft rotates the offset shaft. The offset shaft is located inside the pump chamber and is encircled by the ring. A spacer, such as a bearing, is set on the offset shaft and rolls inside the ring as the crankshaft rotates. The diameter of the spacer and the width of the ring sidewall is chosen such that there is minimal clearance between the ring and the spacer and between the ring and the chamber sidewall.

In another embodiment, the housing can form a pump face, which opens into the pump chamber. A cover plate can attach to the housing to cover the pump face and to form an airtight seal with the pump chamber. The cover plate can attach to the housing, by attaching means including, but not limited to, bolts and screws.

In one embodiment, the pump can comprise a valve that has an anchored end and a free end. The anchored end can be pivotally attached to the pump chamber's inside wall at a position between the inlet port and the outlet port. The free end extends toward the pump chamber's centre. The valve can pivot into a recess in the pump chamber's inside wall in order to make the valve flush with the inside wall surface. During pumping, the valve free end contacts the ring and follows the ring's oscillating movement as the pump is operating. In response to ring contact, the free end is cyclically pushed into the recess until the pushing force from the oscillating ring has passed. The ring and the valve separate the inlet port from the outlet port. The valve can be of various types or styles, including but not limited to a flapper valve, a sliding valve, a wedge valve, a reed valve and a rocking valve.

In another embodiment, the pump can comprise a slider valve slidably disposed in the housing between the inlet port and the outlet port to separate and isolate the two ports from each other. The slider valve can further comprise a bias mechanism to urge the slider valve into the pump chamber and contact the ring and follow the ring's oscillating movement as the pump is operating. In other embodiments, the pump can further comprise a shoe disposed between the slider valve and the ring that can be configured to match the curvature of the ring and to move as the ring oscillates.

In another embodiment, the pump can include adjustable internal by-pass protection means to prevent over-pressuring and to control the output pressure of substances being pumped. The by-pass protection means can comprise, but is not limited to: (a) a check valve, a needle valve or a poppet valve located in a passageway connecting the outlet port to the inlet port, or (b) a spring mounted directly on the offset shaft to limit the pressure applied to ring against the internal wall of the pump chamber allowing substances to by-pass internally in the pump chamber past the ring. In another embodiment, the passageway valve can be controlled by a spring-loaded mechanism, such as a thumbscrew or other suitable means, to adjust and set the pressure at which the valve will open.

The pump on/off means can include, but is not limited to, an electric clutch or a mechanically engaging a gear or shaft operatively coupled to the crankshaft.

In one embodiment, the pump can provide both positive and variable displacement, wherein the volume of substances displaced by the pump can be varied, by increasing or decreasing ring diameter without affecting ring thickness or any other pump dimensions. The volume displaced by the pump is calculable and, therefore, the ring dimensions required for delivering an exact volume per revolution can also be calculated. The volume of substances displaced by the pump per crankshaft revolution is inversely proportional to the ring diameter. As the ring diameter is increased, the volume available for substances in the chamber decreases.

In another embodiment, the pump can be used with a ring of a customized size. Furthermore, the pump can be used with a kit, wherein the kit contains rings of differing diameters, allowing user to change the volume of substances displaced by the pump in order to provide the desired pumping rate.

In representative embodiments, the pump can have few moving parts to promote ease of repair. The pump can be designed with little friction loss in order to lengthen the duration of time the pump stays in calibration and to help ensure long, dependable substance delivery. To reduce wear and to help prevent unwanted or accidental adjustment, the pump can be internally adjustable and can have no exposed parts.

In a representative embodiment, the pump can have a simple design, which allows the pump: (a) to be manufactured at low cost, compared to other pumps in the field; (b) to be used for a variety of applications; and (c) to be made small and light relative to the substance it can inject. In other embodiments, the pump can be made mostly out of plastic for use in small, every day public applications such as soap injectors or agricultural chemical injectors. In further embodiments, the pump can be made with extreme precision with materials to be used in applications including but not limited to medicine, aerospace, or military applications.

Broadly stated, in some embodiments a pump is provided, comprising: a housing comprising an exterior surface and an enclosed interior chamber with a sidewall, the chamber substantially circular in cross-section; an inlet port providing communication between the exterior surface and the interior chamber; an outlet port providing communication between the exterior surface and the interior chamber; a crank assembly comprising a longitudinal axis rotatably disposed within said housing wherein the longitudinal axis is substantially coaxially aligned with the center of the circular cross-section of the interior chamber, the crank assembly configured for receiving input rotational power; a spacer support operatively connected to the crank assembly, the spacer support disposed within the interior chamber, the spacer support further comprising a spacer pin; an annular spacer rotatably disposed on the spacer pin; an annular ring disposed in the interior chamber, the annular ring further comprising a sidewall disposed between the annular spacer and the interior chamber sidewall, the width of the ring sidewall being substantially the same as the minimum distance separating the annular spacer and the interior chamber sidewall; and a slider valve slidably disposed in the housing, the slider valve configured to maintain contact with the ring as the crank assembly is rotating thereby substantially isolating the inlet port from the outlet port.

Broadly stated, in some embodiments a pump is provided, comprising: a housing comprising an exterior surface and an enclosed interior chamber with a sidewall, the chamber substantially circular in cross-section; an inlet port providing communication between the exterior surface and the interior chamber; an outlet port providing communication between the exterior surface and the interior chamber; a crankshaft comprising a longitudinal axis rotatably disposed within the housing wherein the longitudinal axis is substantially coaxially aligned with the center of the circular cross-section of the interior chamber, the crankshaft further configured for receiving input rotational power; an offset shaft having an axis disposed on the crankshaft wherein the offset shaft axis is offset and substantially parallel to the longitudinal axis whereby the offset shaft moves in a substantially circular path within the interior chamber when the crankshaft is rotating; an annular spacer rotatably disposed on the offset shaft; an annular ring disposed about the offset shaft, the annular ring having a sidewall disposed between the spacer and the interior chamber sidewall, the width of the ring sidewall being substantially the same as the minimum distance separating the spacer and the interior chamber sidewall; and a valve disposed between the inlet and outlet ports, the valve configured to maintain contact with the ring as the crankshaft is rotating thereby substantially isolating the inlet port from the outlet port.

DETAILED DESCRIPTION OF EMBODIMENTS

Figure 1:
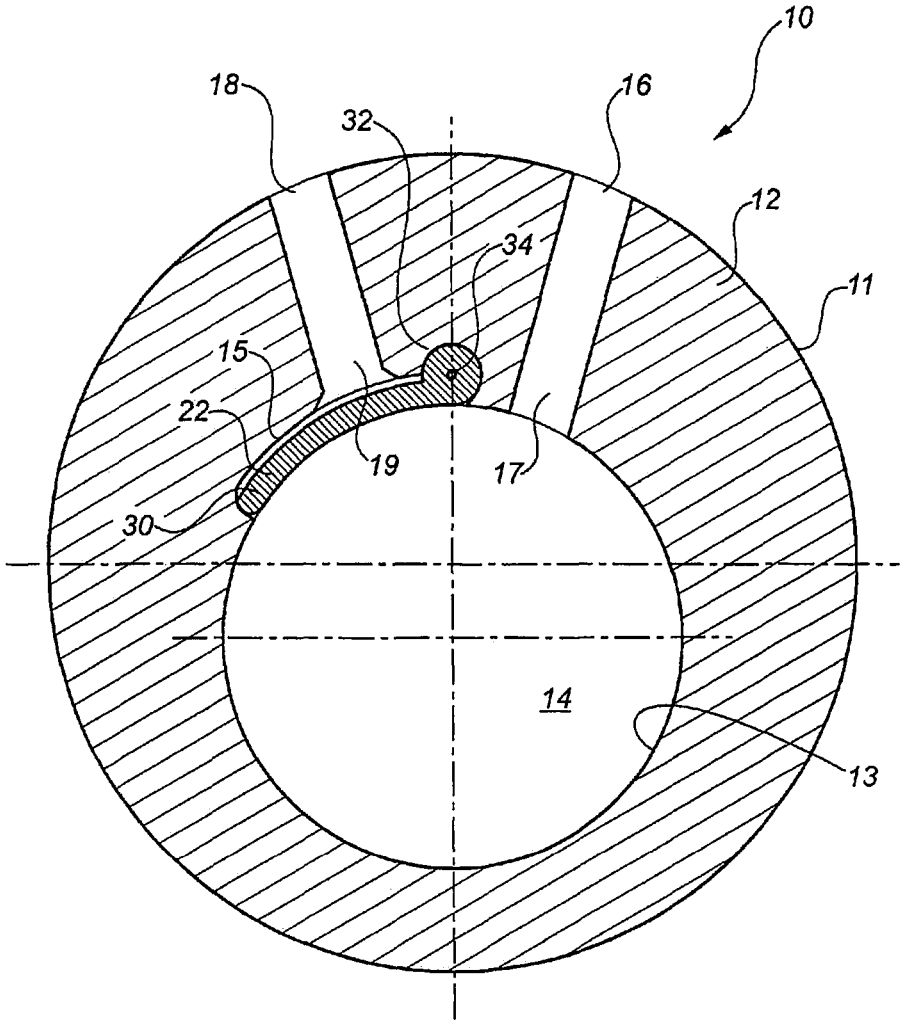
FIG. 1 is a front elevation cross-sectional view depicting a housing of one embodiment of an oscillating ring pump.

Shown in FIG. 1 is a representative embodiment of housing 12 of pump 10. Housing 12 comprises pump chamber 14 having sidewall 13. In this embodiment, chamber 14 can be substantially circular in cross-section. Pump 10 comprises inlet and outlet ports 16 and 18 that provide communication between exterior side 11 of pump 10 and chamber 14. Inlet port 16 terminates in chamber inlet 17 in chamber 14. Outlet port 18 terminates in chamber outlet 19 in chamber 14. In the illustrated embodiment, pump 10 can comprise flapper valve 22 that comprises fixed end 32 and free end 30. Valve 22 can be pivotally attached to housing 12 at pivot point 34 between inlet port 16 and outlet port 18 thereby allowing valve free end 30 swing towards and away from the center of chamber 14. Housing 12 can further comprise recess 15 whereby valve 22 can swing into recess 15 and be substantially flush with chamber sidewall 13.

Figure 2:
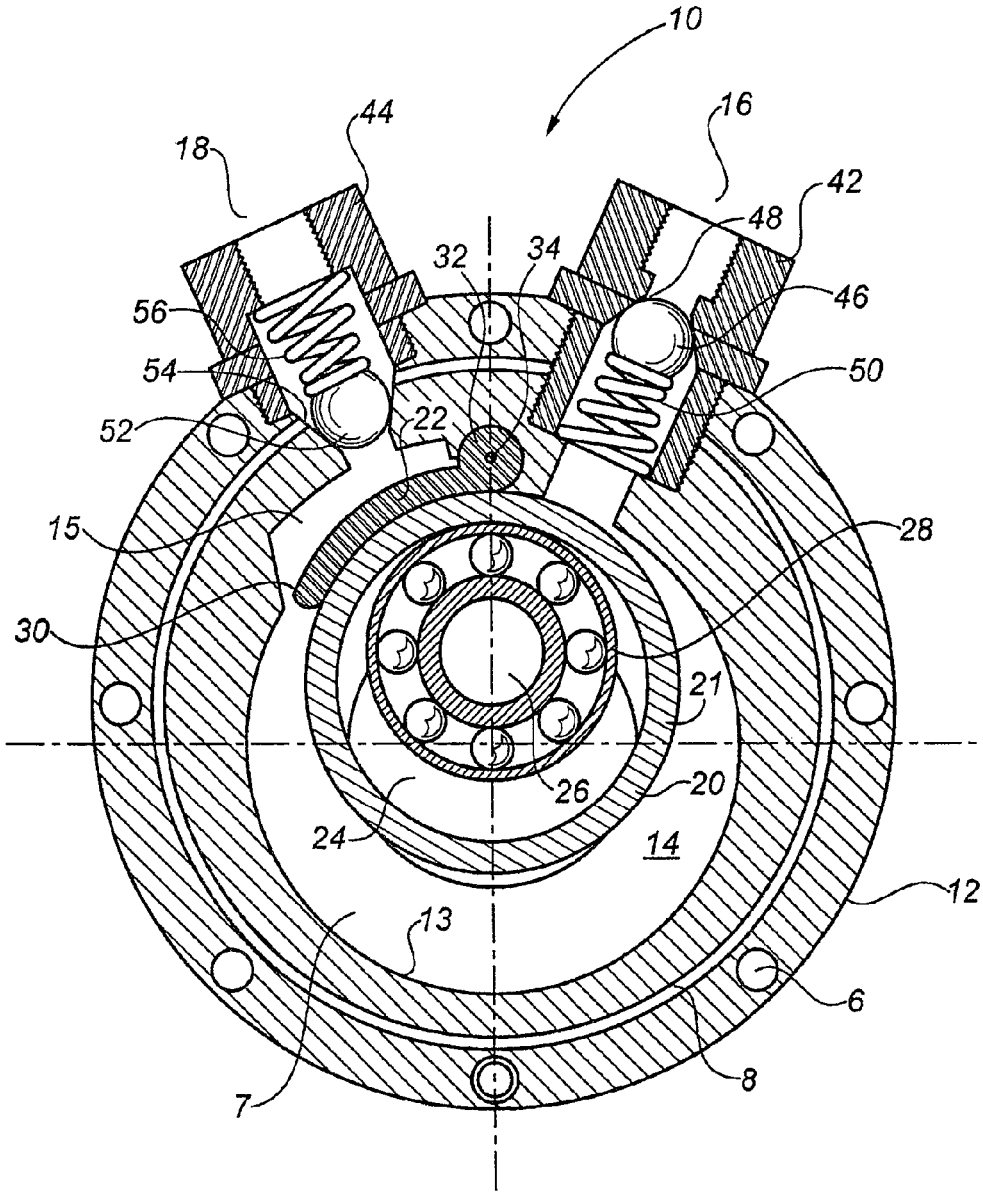
FIG. 2 is a front elevation cross-sectional view depicting one embodiment of an oscillating ring pump.

Referring to FIG. 2, an embodiment of pump 10 is shown with crankshaft 24 disposed at the center of chamber 14. Crankshaft 24 has a longitudinal axis that is substantially perpendicular to chamber wall 7 and is coaxially aligned with the center of chamber 14. Disposed on crankshaft 24 is offset shaft 26. Offset shaft 26 has an axis that is offset and substantially parallel to the longitudinal axis of crankshaft 24 such that offset shaft 26 moves in a circular path within chamber 14 as crankshaft 24 rotates. Annular spacer 28 is placed on offset shaft 26 and can freely rotate about offset shaft 26. In one embodiment, spacer 28 can comprise a roller bearing. In other embodiments, spacer 28 can comprise a needle bearing, a bushing or any other suitable bearing member that can rotate about offset shaft 26 as would be obvious to those skilled in the art. Disposed within chamber 14 is annular pump ring 20 such that it is placed about offset shaft 26. Ring 20 comprises sidewall 21 that has a thickness that can be equal to or less than the minimum distance separating the outer edge of spacer 28 and chamber sidewall 13 whereby there is minimal clearance between spacer 28 and ring 20 and between ring 20 and sidewall 13. In this manner, ring 20 can freely rotate or oscillate within chamber 14 as crankshaft 24 rotates yet maintain contact between spacer 28 and sidewall 13. In another embodiment, ring sidewall 21 can have a rectangular cross-section to maximize the contact with spacer 28 and sidewall 13.

Pump 10 can further comprise inlet check, valve 42 and outlet check valve 44. Check valve 42 can include ball 46 and spring 50. Spring 50 urges ball 46 to rest on valve seat 48 thereby sealing off inlet port 16. Check valve 42 acts to prevent substances from prematurely entering chamber 14. The spring constant of spring 50 determines the required pressure to lift ball 46 off of valve seat 48 and allow substances to enter chamber 14. Similarly, check valve 44 acts to prevent substances from prematurely exiting chamber 14. The spring constant of spring 56 determines the required pressure to lift ball 52 off of valve seat 54 and allow substances to exit chamber 14. In representative embodiment, check valve 42 can be configured with a release pressure of approximately 2 p.s.i. whereas check valve 44 can be configured with a release pressure of approximately 10 p.s.i.

In further embodiments, housing 12 can comprise o-ring groove 8 and boltholes 6. An o-ring seal can be placed in groove 8 to provide a seal between housing 12 and a cover (not shown) that can be bolted to housing 12 using bolts engaging boltholes 6.

In operation, ring 20 can be an oscillating variable displacement ring. The movement of ring 20 pumps substances in and out of chamber 14 via inlet port 16 and outlet port 18, respectively. Crankshaft 24 rotates to move offset shaft 26 in a circular path. Rotation of offset shaft 26 causes ring 20 to oscillate within chamber 14. Oscillation of ring 20 creates vacuum pressure on inlet port 16 to draw substances into pump chamber 14. The vacuum pressure is greater than the release pressure of check valve 42 thereby allowing substances to enter chamber 14 via chamber inlet 17. As ring 20 moves within chamber 14, substances are pushed towards chamber outlet 19 and check valve 44. The pressure on the substances being pumped will exceed the release pressure of check valve 44 and allow substances to then exit via outlet port 18. All the while, the pressure of the substances in chamber 14 will urge free end 30 of flapper valve 22 to maintain contact with ring 20 so as to provide a barrier that prevents substances from moving towards chamber inlet 17.

By maintaining contact with ring 20, free end 30 can be pushed into recess 15 by the movement of ring 20 until ring 20 has cyclically moved past recess 15. Fixed end 32 is positioned on sidewall 13 such that flapper valve 22 covers chamber outlet 19 when pushed into recess 15 by ring 20 thereby closing off chamber outlet 19.

Figure 3:
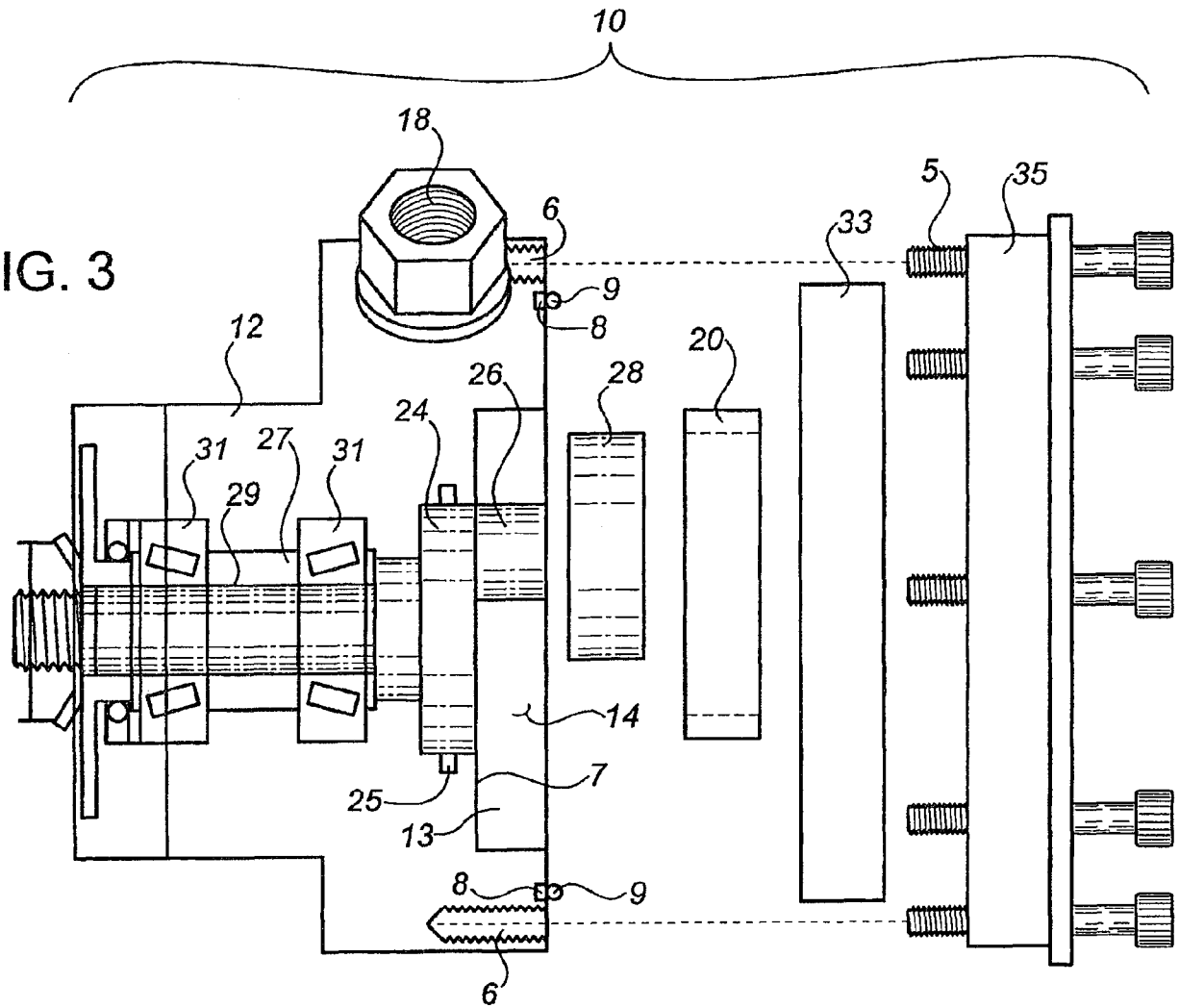
FIG. 3 is a side elevation cross-sectional exploded view depicting the pump of FIG. 2.

Referring to FIG. 3, an exploded side view of pump 10 is shown. In this embodiment, crankshaft 24 can be operatively coupled to input shaft 29 that passes through opening 27 in housing 12 and can be supported by a pair of bearings 31. Bearings 31 can be of the tapered roller variety or any other suitable replacement such as ball bearing, needle bearing, bushing or any other bearing as well known to those skilled in the art. Pump 10 can further include seal 25 disposed around crankshaft 24 to seal off chamber 14. When assembled, spacer 28 is set upon offset shaft 26 and ring 20 is set upon spacer 28. O-ring 9 can be placed in groove 8. Cover 33 is placed against o-ring 9 on housing 12 to enclose and seal chamber 14. Cover 33 can be secured into position with retainer ring 35 fastened to housing 12 by bolts 5 threaded into boltholes 6. Cover 33 can be made of any suitable material that can withstand the pressure of substances being delivered by pump 10. In a representative embodiment, cover 33 can be made of transparent Plexiglas of suitable thickness so as to enable visual inspection of pump 10 when in operation.

Figure 4:
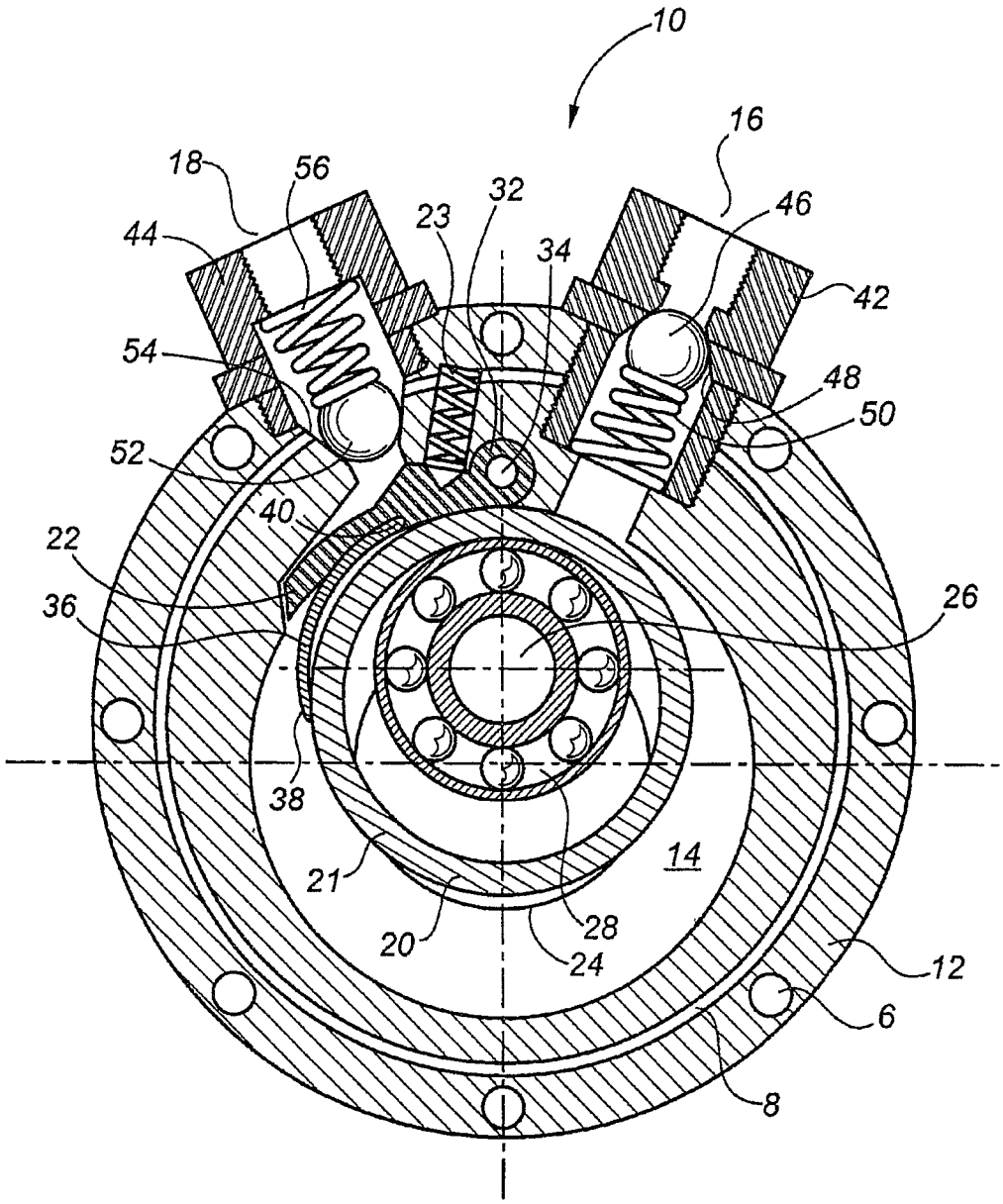
FIG. 4 is a front elevation cross-sectional view depicting a first alternate embodiment of an oscillating ring pump.

Referring to FIG. 4, another embodiment of pump 10 is shown. In this embodiment, flapper valve 22 can further include reed valve 36. Reed valve 36 has fixed end 40 and free end 38. Reed valve 36 can be positioned between flapper valve 22 and ring 20. Reed valve 36 can be made of flexible material, such as spring steel or other suitable materials as known to those skilled in the art. The inclusion of reed valve 36 can enhance the seal made by flapper valve 22 when it contacts ring 20.

In another embodiment, pump 10 can include biasing means to urge flapper valve 22 to contact ring 20. In one embodiment, the biasing means can comprise spring 23 or it can be any other suitable mechanism as known to those skilled in the art.

Figure 5:
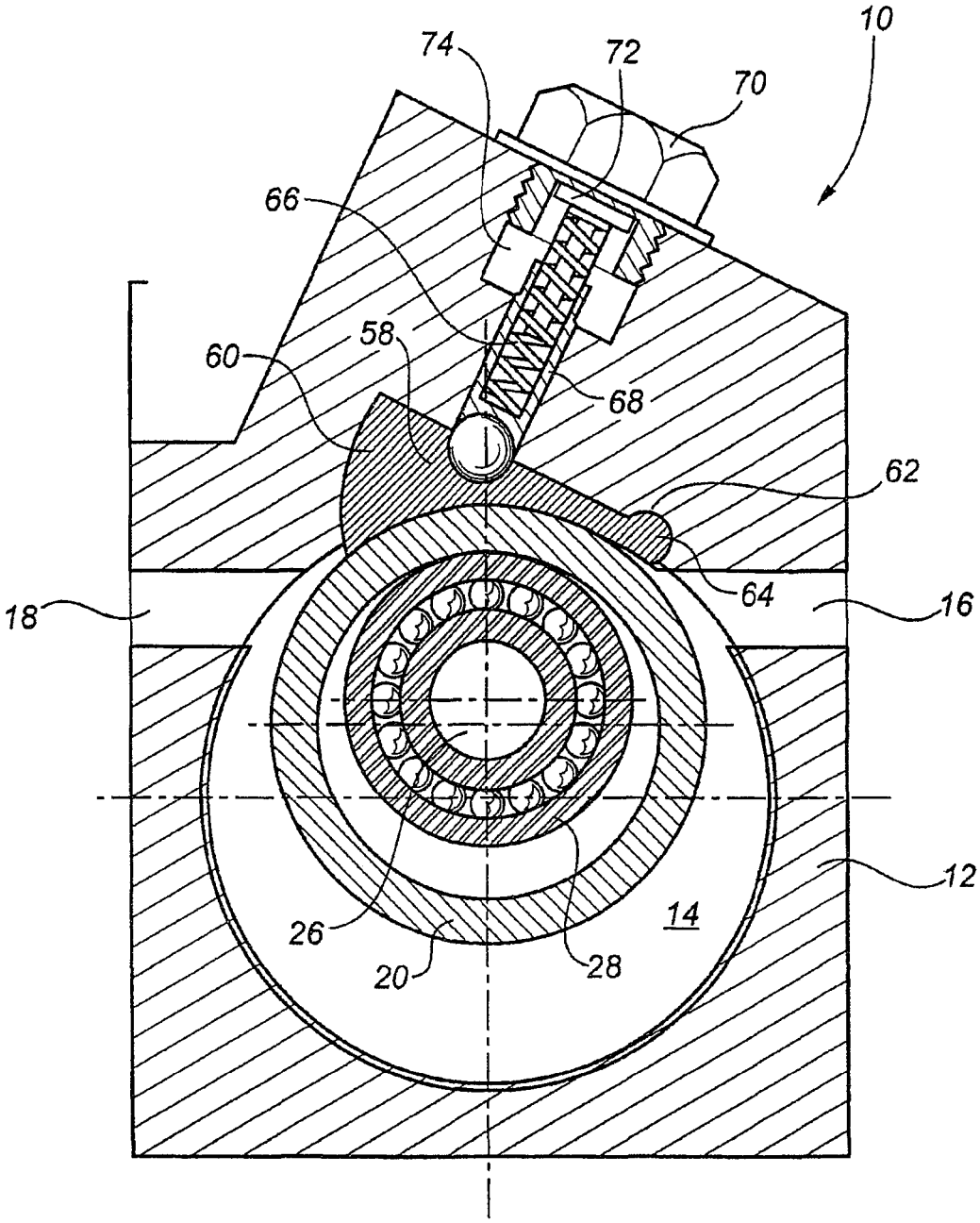
FIG. 5 is a front elevation cross-sectional view depicting a second alternate embodiment of an oscillating ring pump.

Referring to FIG. 5, another embodiment of pump 10 is shown. In this embodiment, pump 10 can use wedge 58 as a valve as described above. Wedge 58 has fixed end 62 that is pivotally attached to housing 12 at pivot point 64 and free end 60 that contacts ring 20. In this embodiment, spring 66 urges wedge 58 towards ring 20. Spring 66 is secured in place by spring sleeve 68 and bolt 70 threaded into opening 74 in housing 12. Shim 72 can be placed between spring 66 and bolt 70. Shim 72 can be varied in thickness to vary the pre-load tension on spring 66, that is, thinner shims will reduce the tension whereas thicker shims will increase the tension.

Figure 6:
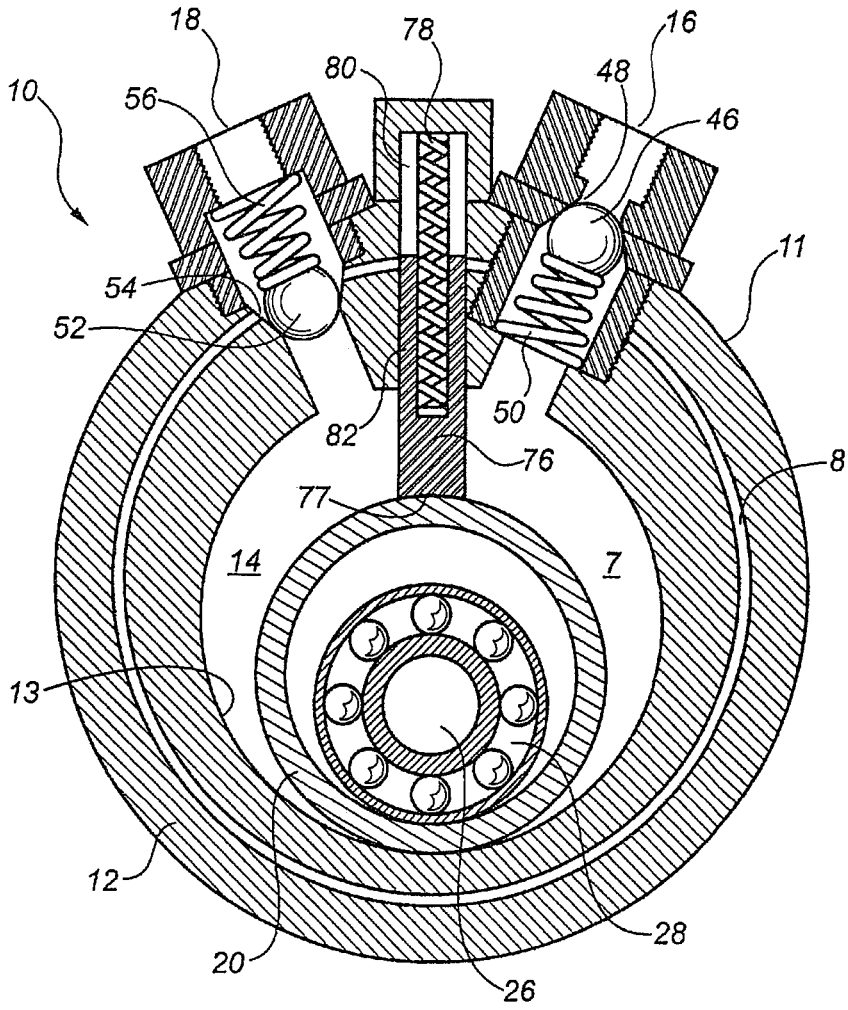
FIG. 6 is a front elevation cross-sectional view depicting a third alternate embodiment of an oscillating ring pump.

Referring to FIG. 6, another embodiment of pump 10 is shown. In this embodiment, slider valve 76 can be used to separate or isolate inlet 16 from outlet 18. Slider valve 76 comprises valve face 77 that contacts ring 20. Slider valve 76 is slidably disposed in valve guide opening 80 in housing 12 that is configured to receive slider valve 76. Spring 78 can be disposed within opening 80 and valve 76 as illustrated to provide biasing means to urge slider valve 76 to the center of chamber 14 and to have slider valve face 77 maintain contact with ring 20. In this embodiment, slider valve 76 can be configured to be substantially perpendicular to exterior surface 11 of housing 12.

Figure 7:
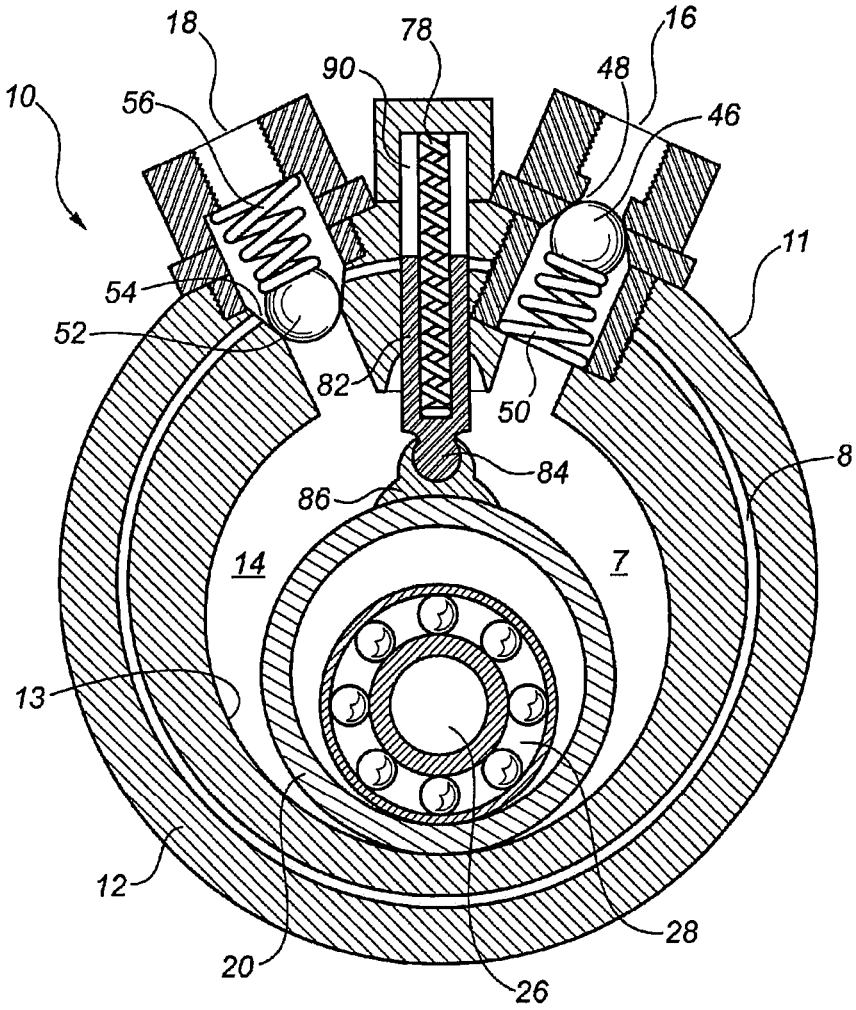
FIG. 7 a front elevation cross-sectional view depicting a fourth alternate embodiment of an oscillating ring pump.

Referring to FIG. 7, another embodiment of pump 10 is shown. In this embodiment, pump 10 can have slider valve 82 slidably disposed in valve guide opening 90 disposed in housing 12 to receive slider valve 82. Slider valve 82 can further comprise ball end 84 with valve shoe 86 rotatably coupled thereon. Shoe 86 can rotate on ball end 84 to maintain contact with ring 20 as ring 20 oscillates within chamber 14. Spring 78 can be disposed within opening 90 and valve 82 as illustrated to provide biasing means to urge slider valve 82 to the center of chamber 14 and to have slider valve shoe 86 maintain contact with ring 20.

Figure 8:
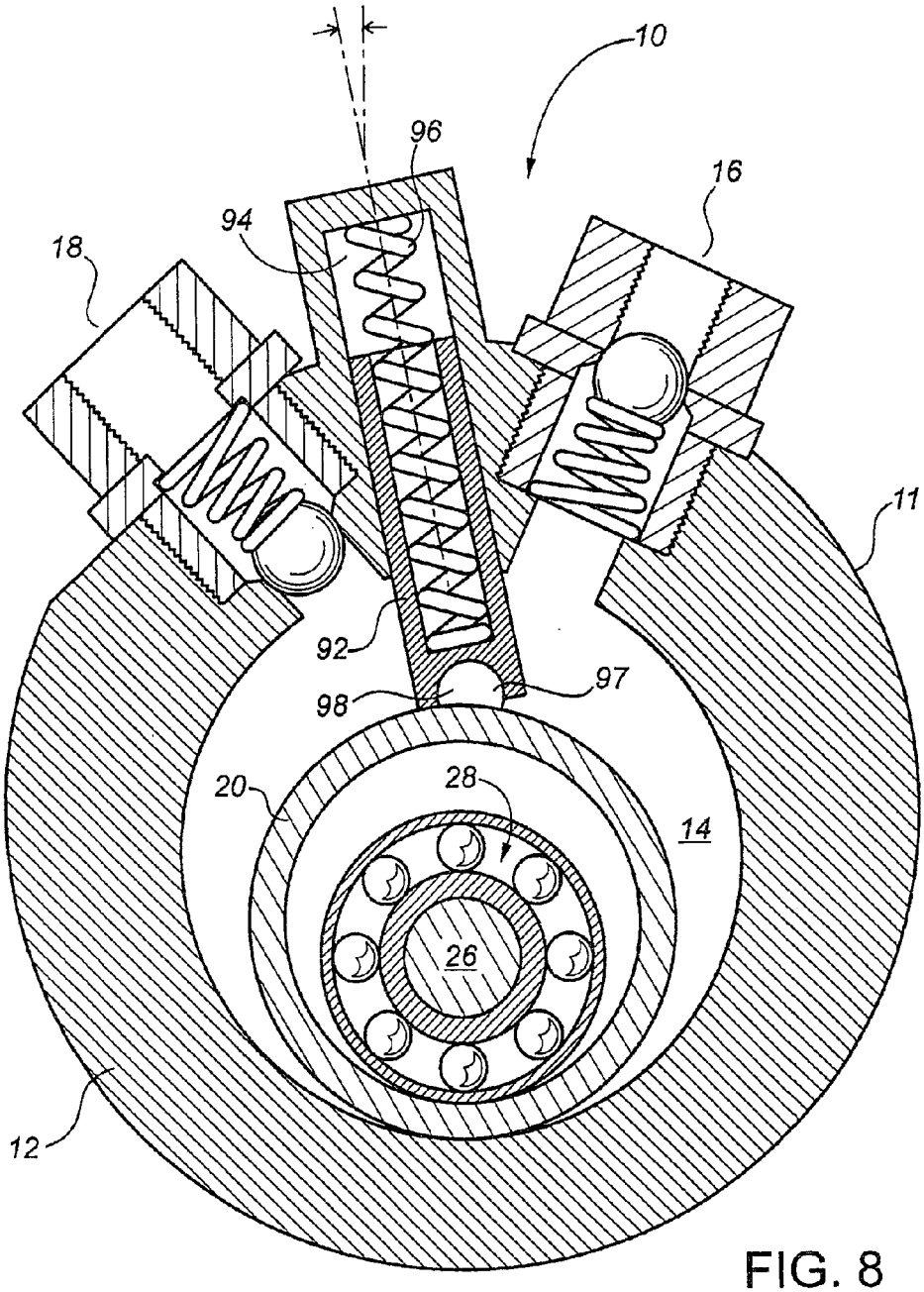
FIG. 8 is a front elevation cross-sectional view depicting a fifth alternate embodiment of an oscillating ring pump.

Referring to FIG. 8, another embodiment of pump 10 is shown. In this embodiment, slider valve 92 and valve guide opening 94 disposed at an angle with respect to exterior surface 11 of housing 12. In a representative embodiment, slider valve 92 and opening 94 are canted at an angle of approximately 10° off of vertical. In this embodiment, slider valve 92 can include opening 97 configured to receive valve shoe 98 that maintains contact with ring 20 as it rotates within chamber 14. In this embodiment, shoe 98 can be semi-circular in cross-section and can have a concave contact surface for contacting ring 20. Spring 96 can be disposed within opening 94 and valve 92 as illustrated to provide biasing means to urge slider valve 92 to the center of chamber 14 and to have slider valve shoe 98 maintain contact with ring 20.

Figure 9:
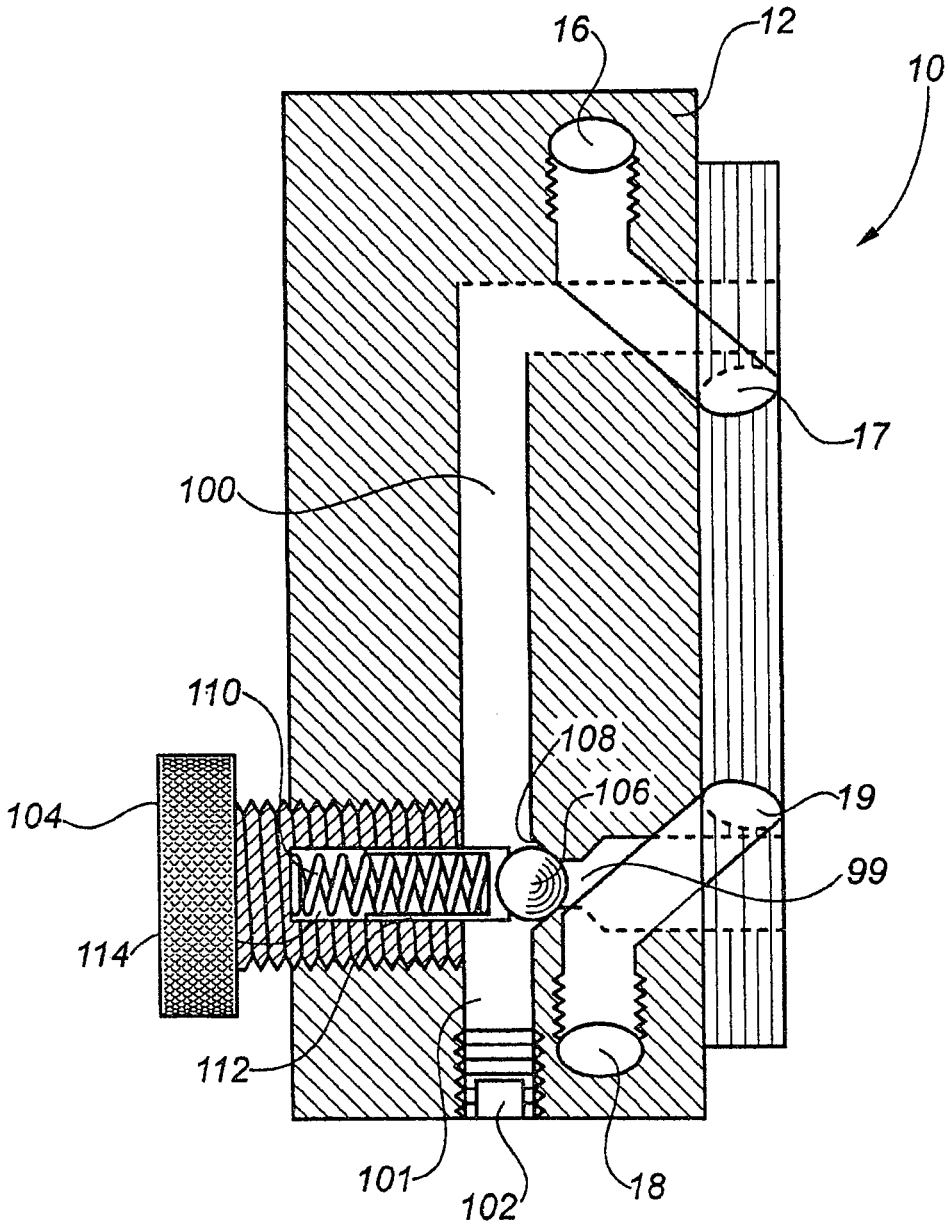
FIG. 9 is a top cross-sectional plan view depicting a pressure relief/bypass valve on the ring pump of FIG. 2.

Referring to FIG. 9, another embodiment of pump 10 is shown. In this embodiment, pump 10 can comprise passageway 100 disposed in housing 12 to provide means for controlling the output pressure or amount of substances delivered by pump 10. In the illustrated embodiment, housing 12 can comprise passageway 99 that provides communication between passageway 100 and the passageway that connects chamber outlet 19 to output port 18. Passageway 99 can further comprise valve seat 108 for receiving ball valve 106. Biasing means can be provided to urge ball valve 106 against valve seat 108 to close off passageway 99. In the illustrated embodiment, the biasing means can include thumbscrew 104, spring 110 and spring sleeve 112. Spring 110 and spring sleeve 112 can be slidably disposed within opening 114 of thumbscrew 104. The output pressure of substances delivered by pump 10 is dependent on the pressure required to lift ball valve 106 off of valve seat 108. The more thumbscrew 104 is threaded into housing 12, the more spring 110 is compressed to increase the pressure required to open ball valve 106. The more thumbscrew 104 is threaded out of housing 12, the less spring 110 is compressed thereby decreasing the pressure to open ball valve 106. In a further embodiment, passageway 100 can comprise access port 101 and plug 102 to close off port 101 during operation of pump 10. It should obvious to those skilled in the art that means other than a ball valve can be used to control the output pressure of substances delivered by pump 10 such as a needle valve as well as any other suitable means.

Figure 10:
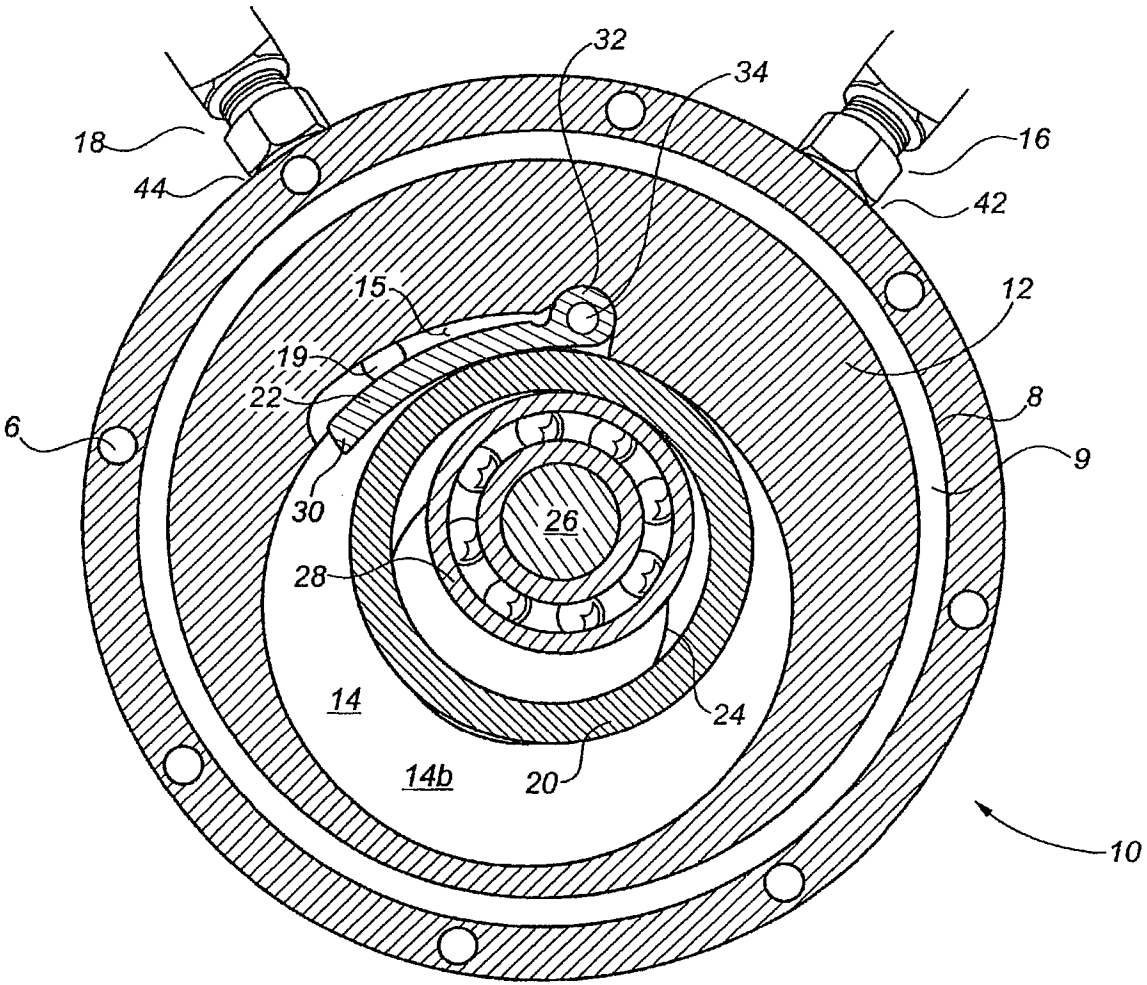
FIG. 10 is a front elevation cross-sectional view depicting the oscillating ring pump of FIG. 2 with the ring located near top dead centre ("TDC").

Referring to FIGS. 10 to 14, operation of an embodiment of pump 10 is illustrated. In FIG. 10, pump 10 is shown with ring 20 at approximately top dead center ("TDC"). For the purpose of these illustrations, substances are contained in pump chamber 14 in this initial condition. Pump 10 begins to operate when input rotational power is applied to crankshaft 24. The input rotational power is applied to an input shaft (not shown) operatively attached to crankshaft 24. The input rotational power can be obtained from any suitable source such as a motor or from rotating shafts that are operatively coupled to the input shaft, either by meshed gears, a belt and pulleys, a chain and sprockets or any other suitable means as well known to those skilled in the art. In the illustrated embodiment, crankshaft 24 can rotate clockwise as shown in chamber 14 thereby allowing flapper valve 22 to move away from recess 15. It should be obvious to one skilled in the art, however, that pump 10 can be assembled in a mirrored configuration whereupon crankshaft 24 can rotate in a counter clockwise direction.

Figure 11:
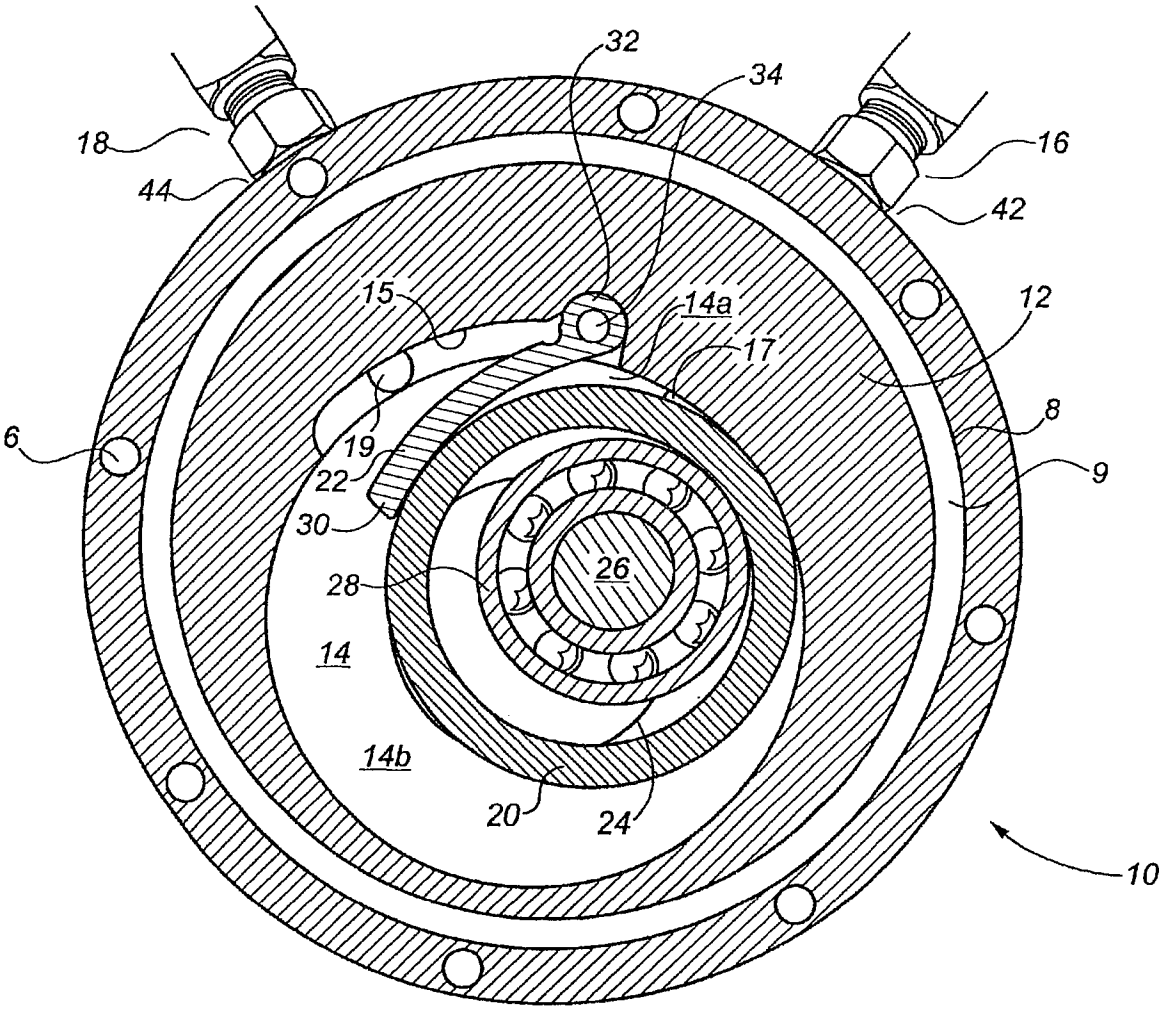
FIG. 11 is a front elevation view depicting the oscillating ring pump of FIG. 2 with the ring rotated about 80° clockwise from TDC.

Referring to FIG. 11, ring 20 is at approximately 80° rotated from TDC. In this position, flapper valve 22 has moved away from recess 15 to expose chamber outlet 19. Substances in pump chamber 14 are forced through chamber outlet 19 and exit through check valve 44 and output port 18. As ring 20 rotates clockwise, pump chamber inlet side 14*a* is formed and begins to create a vacuum to draw in substances through inlet port 16, check valve 42 and chamber inlet 17.

Figure 12:
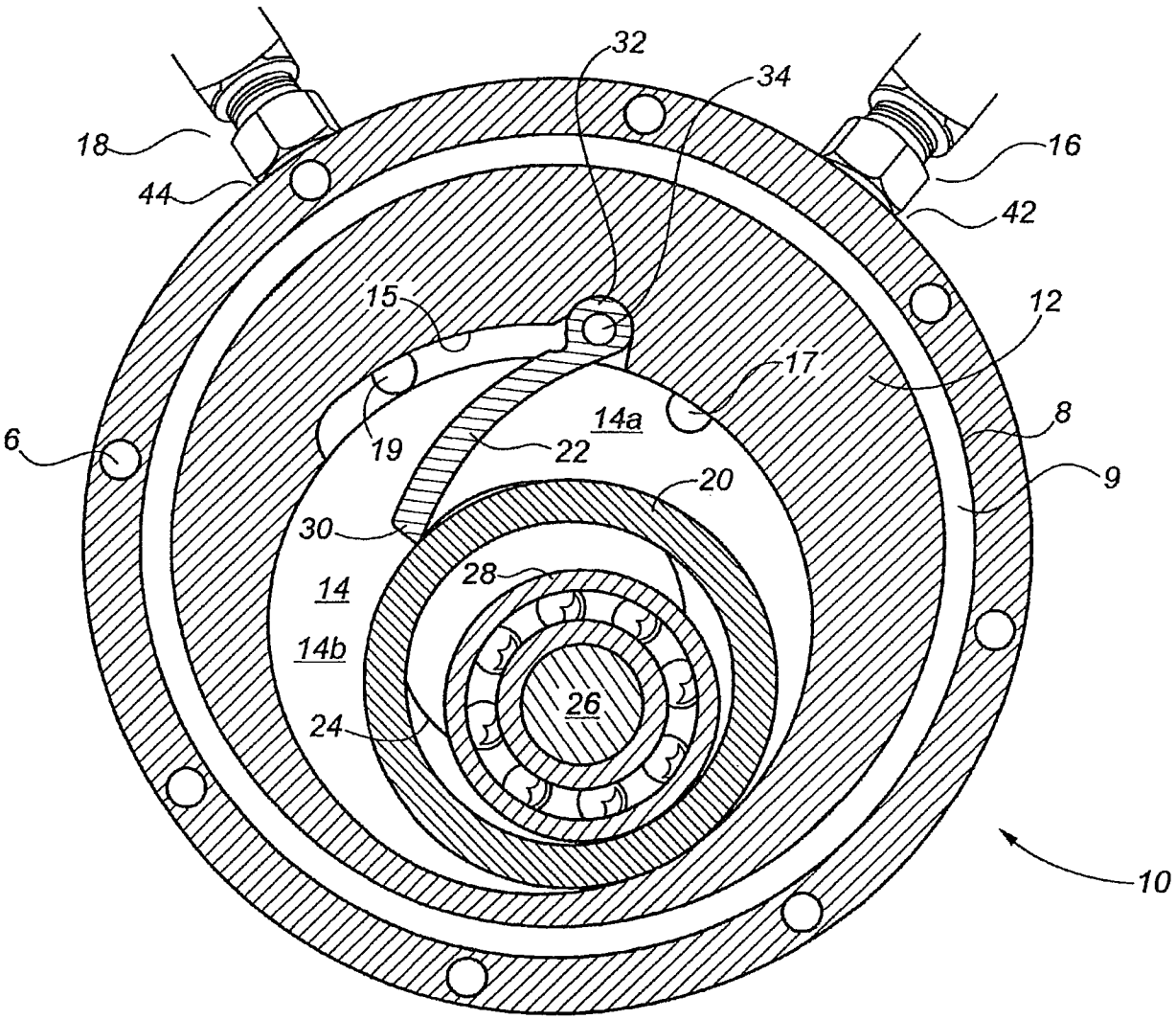
FIG. 12 is a front elevation view depicting the oscillating ring pump of FIG. 2 with the ring rotated about 175° clockwise from TDC.

Referring to FIG. 12, pump ring 20 is shown at approximately 175° rotated from TDC. In this position, pump chamber inlet side 14*a* is approximately the same volume as pump chamber outlet side 14*b*. As ring 20 rotates clockwise, the volume of pump chamber outlet side 14*b* decreases thereby forcing substances through chamber outlet 19 to exit through check valve 44 and outlet port 18. Flapper valve 22 acts as a barrier between pump chamber outlet side 14*b* and pump chamber inlet side 14*a*. As crankshaft 24 continues to rotate clockwise, pump chamber inlet side 14*a* increases in volume thereby drawing in more substances in through chamber inlet 17.

Figure 13:
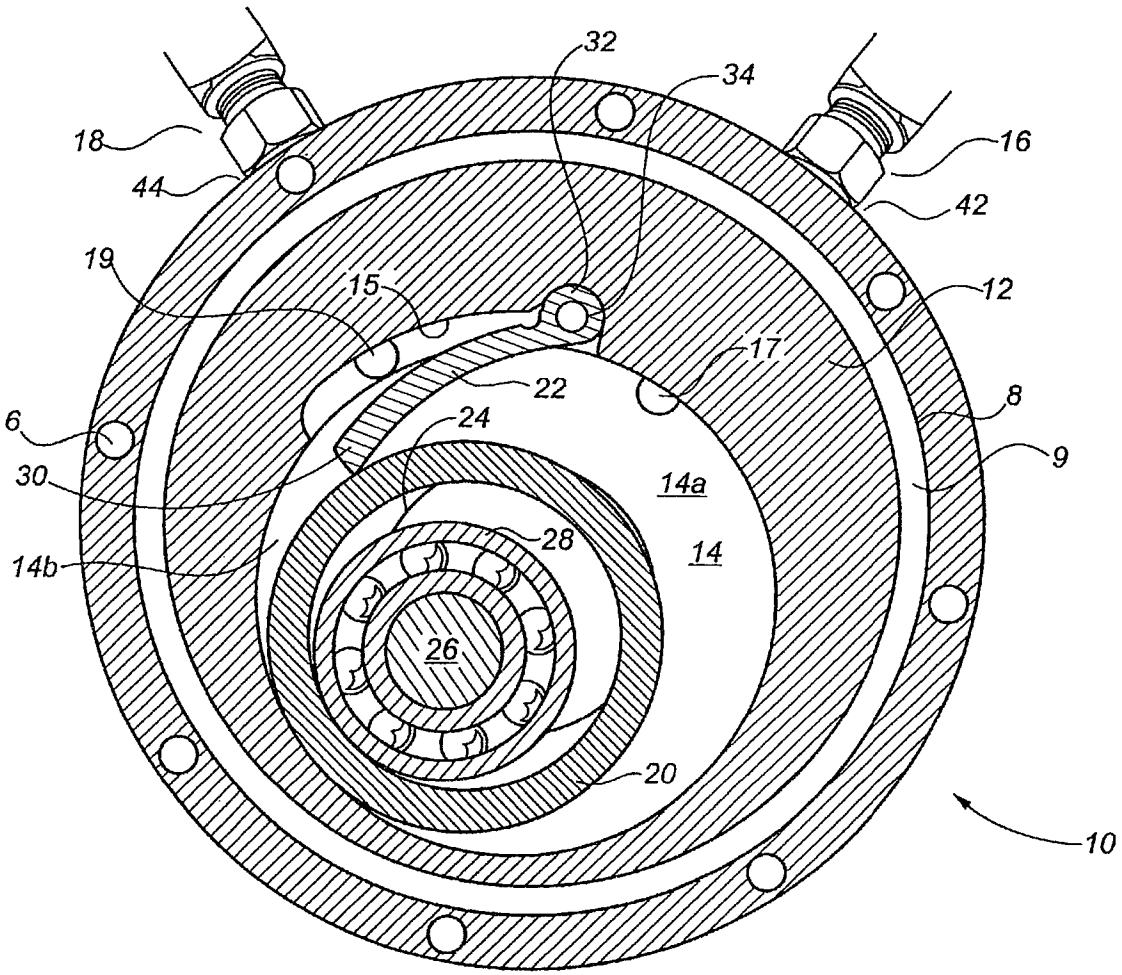
FIG. 13 is a front elevation view depicting the oscillating ring pump of FIG. 2 with the ring rotated about 240° clockwise from TDC.

Referring to FIG. 13, pump ring 20 is shown at approximately 240° rotated from TDC. In this position, the volume of pump chamber outlet side 14*b* has decreased and flapper valve 22 has begun to retreat back into recess 15 to close off chamber outlet 19. The volume of pump chamber inlet side 14*a* continues to increase to draw in more substances through chamber inlet 17.

Figure 14:
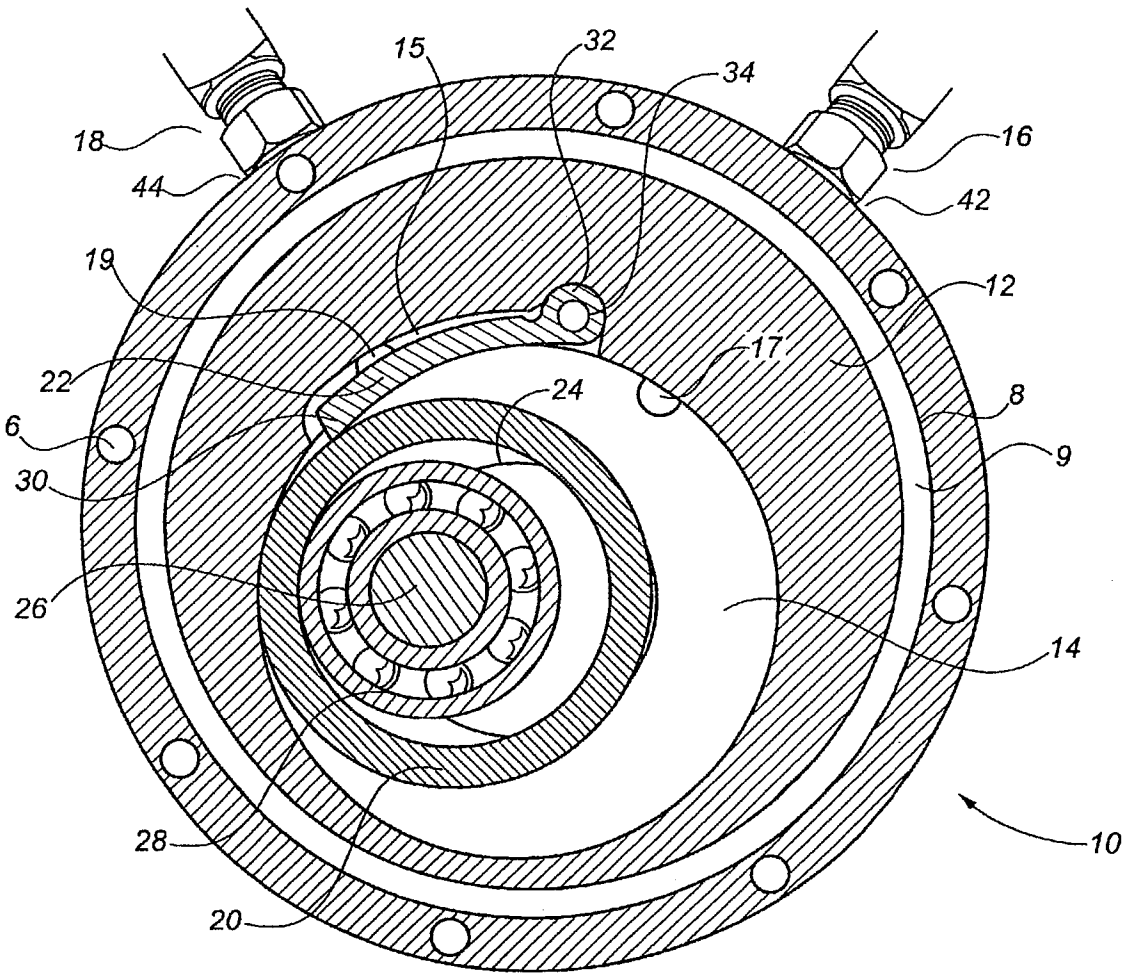
FIG. 14 is a front elevation view depicting the oscillating ring pump of FIG. 2 with the ring rotated about 270° clockwise from TDC.

Referring to FIG. 14, pump ring 20 is shown at approximately 270° rotated from TDC whereby the volume of pump chamber outlet side 14*b* has been decreased to nearly zero. Flapper valve 22 is almost fully retracted into recess 15 to close off chamber outlet 19. As pump ring 20 continues to move clockwise to TDC, the pumping process continues in the manner described whereby substances are drawn into and pumped out of pump chamber 14 simultaneously with each revolution of crankshaft 24. The volume of substances displaced by pump 10 in each revolution of crankshaft 24 is a function of the diameter of ring 20. As the diameter of ring 20 is increased, the amounts of substances drawn in and expelled by pump 10 decreases as the available volume for pump chamber inlet and outlet sides 14*a* and 14*b* has decreased. Similarly, as the diameter of ring 20 is decreased, the amounts of substances drawn in and expelled by pump 10 increases as the available volume for pump chamber inlet and outlet sides 14*a* and 14*b* has increased.

In another embodiment of pump 10, pump 10 can be provided with a kit having a multiple number of rings 20 in various diameters but all having sidewall 21 of the same thickness. In this fashion, pump 10 can be easily configured to change the amount of substances it can displace or deliver simply by changing ring 20 of one diameter for another ring 20 having a different diameter. In this regard, a pump having variable displacement can be provided.

Figure 15A:
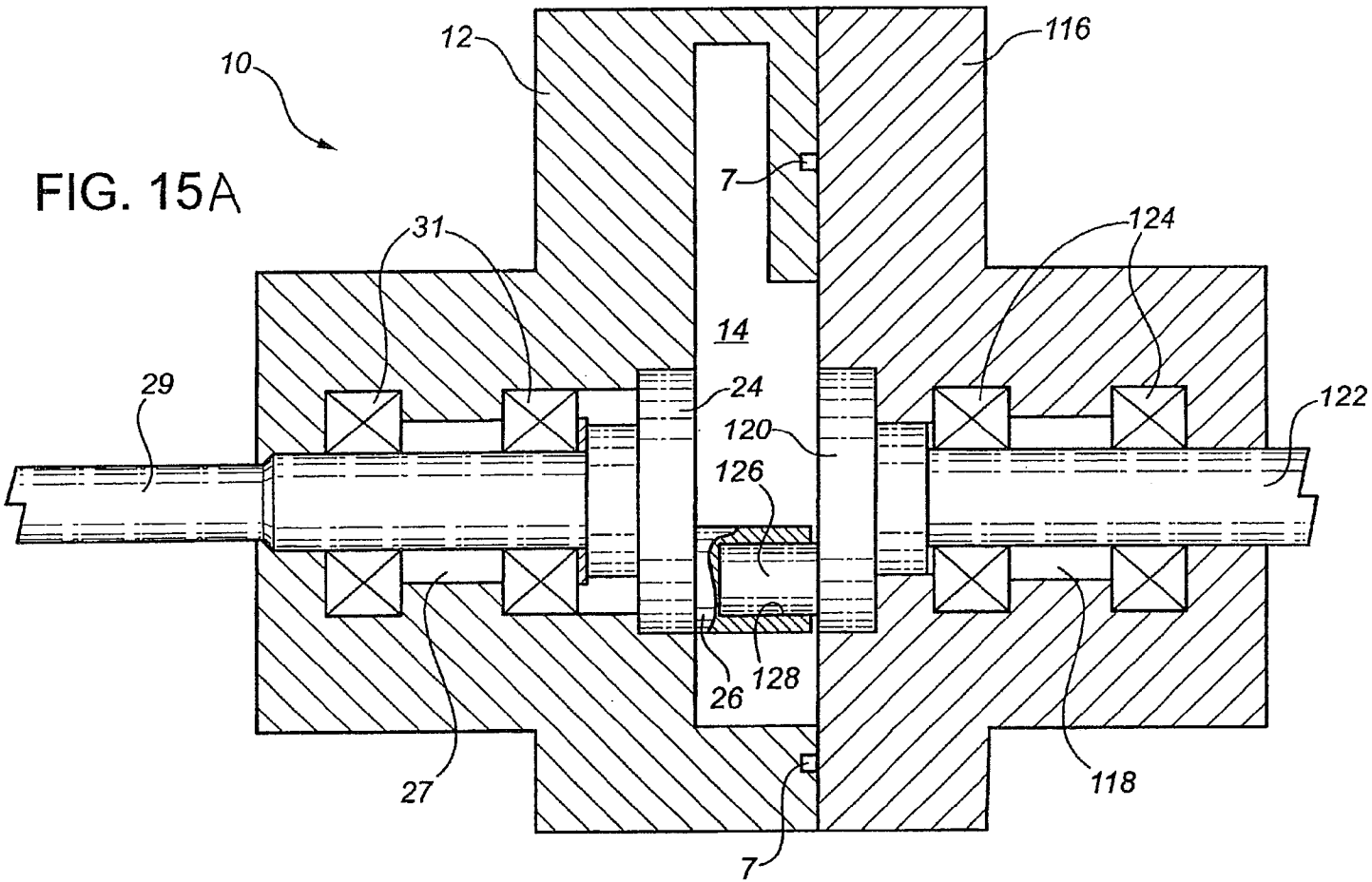
FIG. 15A is a side elevation cross-sectional view depicting a sixth alternate embodiment of an oscillating ring pump.

Referring to FIG. 15A, a side view of pump 10 is shown. In this embodiment, crankshaft 24 can be operatively coupled to input shaft 29 that passes through opening 27 in housing 12 and can be supported by a pair of bearings 31. Disposed on the end of offset shaft 26 is opening 128 that can receive offset shaft 126 disposed on crankshaft 120. Crankshaft 120 can be rotatably disposed within housing cover 116 that can be, in turn, fastened to housing 12 using bolts, screws or any other suitable means. O-ring 7 can be placed between housing 12 and housing cover 116 to seal off chamber 14. Crankshaft 12 can be operatively coupled to output shaft 122 which can be supported in shaft opening 118 of housing cover 116 by bearings 124. Bearings 31 and 124 can be of the tapered roller variety or any other suitable replacement such as ball bearing, needle bearing, bushing or any other bearing as well known to those skilled in the art. Output shaft 122 can be used in any number of ways to provide rotational power to other devices. In one embodiment, one or more pumps 10 can be connected in tandem whereby the input shaft of one pump 10 is operatively coupled to the output shaft of a previous pump 10. In this fashion, different substances can be pumped simultaneously at the same, one substance per pump in the tandem.

Figure 15B:
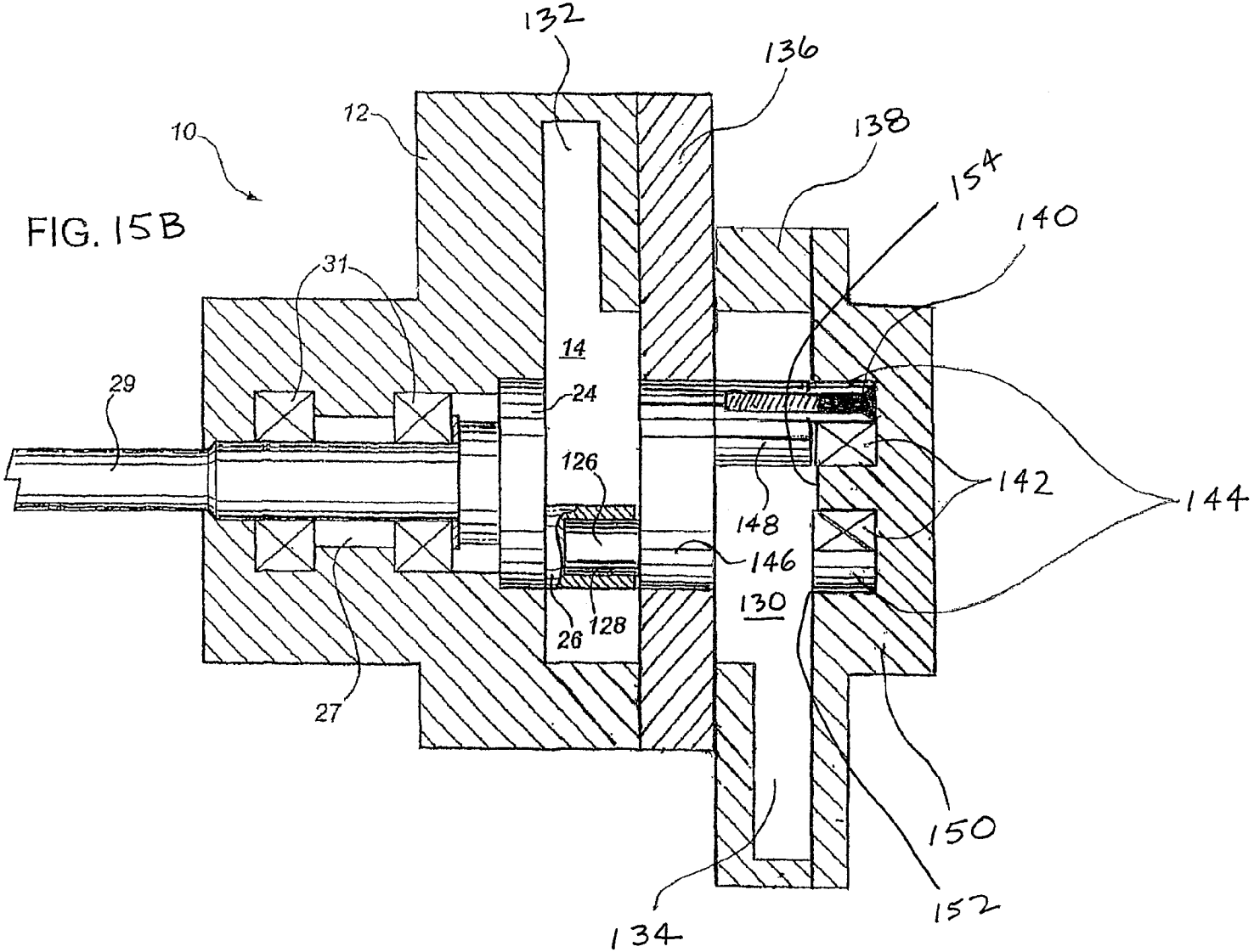
FIG. 15B is a side elevation cross-sectional view depicting a seventh alternate embodiment of an oscillating ring pump.

Referring to FIG. 15B, another embodiment of pump 10 is shown. In some embodiments, pump 10 can comprise two or more chambers stacked end-to-end. In the illustrated embodiment, pump 10 can comprise chambers 14 and 130 separated by adaptor plate 136, which can further comprise crankshaft extension adaptor 146 rotatably disposed in an opening disposed therein. Ring 20 and the inlet and outlet check valves are not shown in the figure to simplify the description of this embodiment of pump 10 but would otherwise be included in a working version of this embodiment. Offset shaft 126 can be operatively coupled to adaptor 146. Offset shaft 126 can be rotatably disposed in opening 128 disposed in offset shaft 26. Chamber 130 can be defined by housing 138 operatively coupled to adaptor plate 136, and end cover plate 150 operatively coupled to housing 138. In some embodiments, extension adaptor 146 can comprise extension offset shaft 148 extending into chamber 130. Offset shaft 148 can further comprise coupler 140 extending therefrom to operatively couple crankshaft end support ring 144. Support ring 144 can be disposed in recess 152 disposed in end cover plate 150. In some embodiments, end cover plate 150 can further comprise end support bearing 142 disposed on protrusion 154 extending from end cover plate 150 in recess 152. In operation, crankshaft 24 rotates thereby causing offset shaft 26 to rotate within chamber 14. This can cause adaptor 146 to rotate and, hence, offset shaft 148 to rotate in chamber 130. The coupling of offset shaft 148 to end support ring 144 via coupler 140 can support the rotation of offset shaft 148 in chamber 130 as support ring 144 rotates on bearing 142. When rings 20 are placed on offset shafts 26 and 148 in chambers 14 and 130, respectively, substances being pumped in chamber 14 can exit through outlet port 132 whereas substances being pumped in chamber 130 can exit through outlet port 134. It is obvious to those skilled in the art that pump 10 as illustrated can be adapted to have multiple chambers or pump stages stacked end-to-end.

In another embodiment, two or more pumps can be connected in tandem to pump the same substance thereby increasing the amount of substances that can be delivered per revolution of the pump crankshafts.

In a further embodiment, an input manifold, as well known to those skilled in the art, can be used to collectively feed the input ports of the tandem-connected pumps from a single source of substances.

In yet another embodiment, an output manifold can be used to connect the output ports of the tandem-connected pumps to a single output whereby all of the pumped substances are delivered from a single output port.

In yet a further embodiment, the offset shafts of the tandem-connected pumps can be rotationally spaced apart from one another with respect to the longitudinal axis of the crankshafts. For example, in a two tandem pump configuration, the offset shafts can be spaced approximately 180° apart. For a three tandem pump configuration, the offset shafts can be spaced approximately 120° apart, and so on. By configuring the offset shafts in this manner, especially when using an output manifold, the pulsing of delivered substances that naturally occurs with a single pump can be reduced or smoothed out in the delivery of substances exiting the output manifold.

Figure 16:
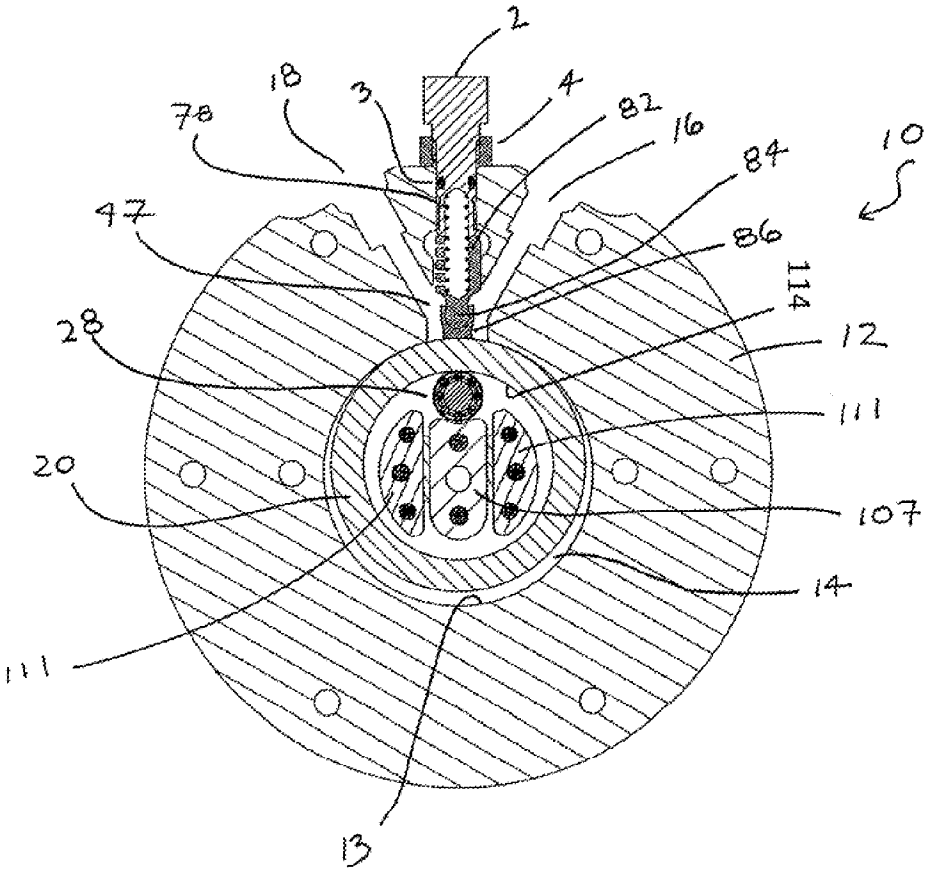
FIG. 16 is front elevation cross-sectional view depicting an alternate embodiment of the oscillating ring pump of FIG. 7.

Referring to FIG. 16, another embodiment of pump 10 is shown. This embodiment is similar to the embodiment shown in FIG. 7 except that inlet 16 and outlet 18 converge to form valve chamber 47. In this FIG. 16, inlet 16 and outlet 18 are shown without check valves installed. It is obvious to those skilled in the art that check valves as shown FIG. 7, or their functional equivalents, can be installed in inlet 16 and outlet 18 to enable the functioning of pump 10.

In some embodiments, pump 10 can comprise slider valve 82 slidably disposed in a valve guide opening disposed in housing 12 to receive slider valve 82. Slider valve 82 can further comprise ball end 84 with valve shoe 86 rotatably coupled thereon. The combination of slider valve 82 and valve shoe 86 can extend through valve chamber 47 to contact ring 20 thereby separating and isolating inlet 16 from outlet 18. Shoe 86 can rotate on ball end 84 to maintain contact with ring 20 as ring 20 oscillates within chamber 14. Spring 78 can be disposed within slider valve 82 as illustrated to provide biasing means to urge slider valve 82 to the center of chamber 14 and to have slider valve shoe 86 maintain contact with ring 20. Bolt 2 can thread into the valve guide opening to adjust the bias on spring 78. Locknut 4 can be disposed on bolt 2 to tighten against housing 12 to keep bolt 2 in position once the desired bias on slider valve 82 has been set. Bolt 2 can further comprise o-ring 3 disposed therearound in the valve guide opening as means to prevent substances being pumped through pump 10 by escaping through the valve guide opening. In some embodiments, spacer 28 can comprise a bearing to, contact ring 20 and bias ring 20 towards sidewall 13 of chamber 14. In some embodiments, spacer 28 can be disposed on sliding support 107, which can be disposed between a pair of support guides 111 that limit the motion of sliding support 107 to that of a linear motion in the channel defined by offset faces 114 and guides 111.

Figure 17:
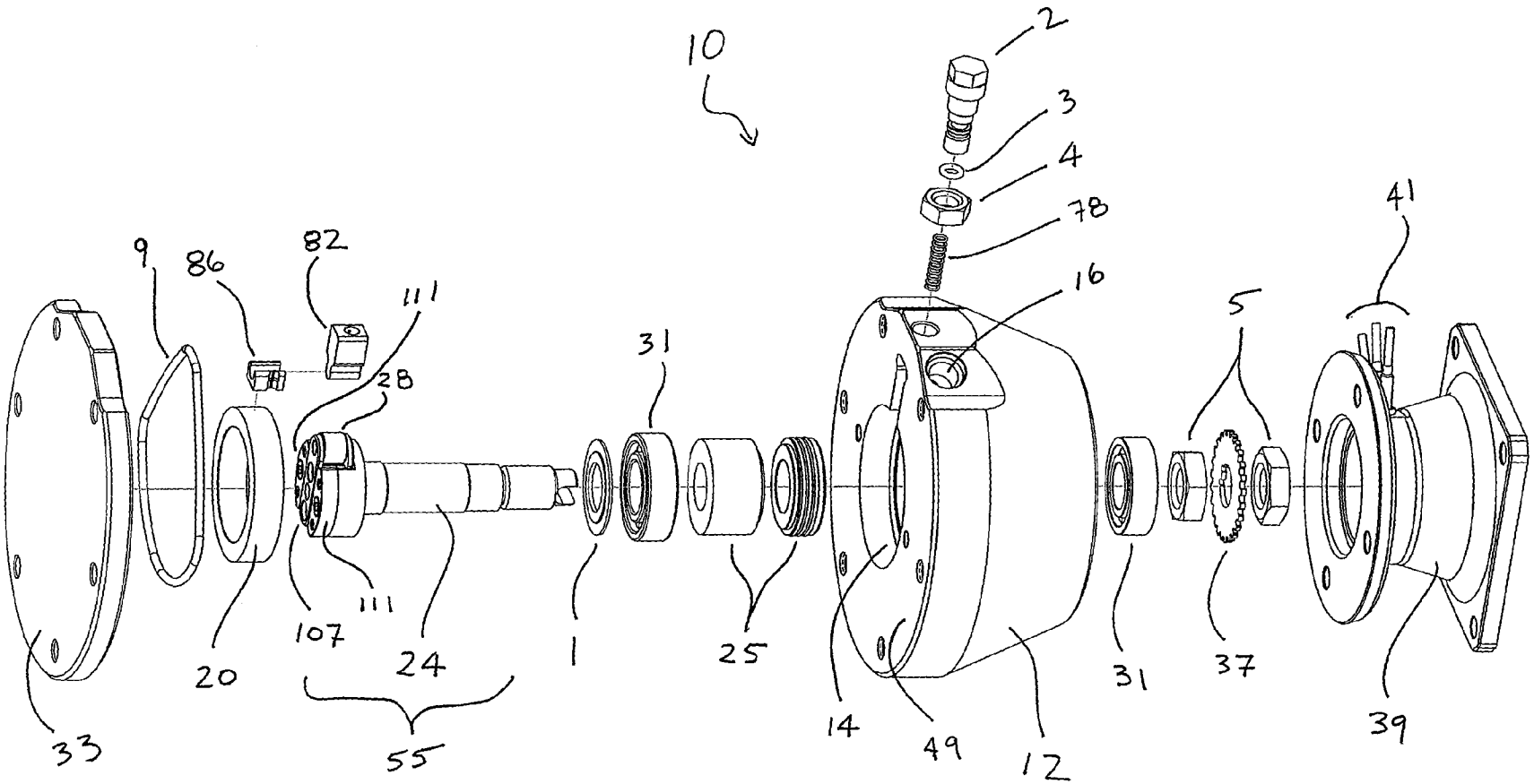
FIG. 17 is an exploded perspective view, depicting the oscillating ring pump of FIG. 16.

Referring to FIG. 17, an exploded view of pump 10 is shown. In some embodiments, crank assembly 55 can comprise crankshaft 24, sliding support 107, guides 111 and spacer 28. Crank assembly 55 can pass through bearing spacer 1, bearing 31 and seal assembly 25 through chamber 14 of housing 12 to pass through another bearing 31 and pulser ring 37, which is held in position on crankshaft 24 by locknuts 5. When assembled, ring 37 is disposed within bracket housing 39 whereby ring 37 can rotate therein in proximity to proximity sensors 41 mounted on bracket housing 39. Proximity sensors 41 can comprise rotation detection means as well known to those skilled in the art to determine direction and rate of rotation of crankshaft 24. Once crank assembly 55 is disposed within housing 12, with ring 20 disposed within chamber 14, chamber 14 can be enclosed by pump cover 33 attached to housing face 49 of housing 12. Cover 33 can further comprise o-ring 9 placed in a groove disposed thereon to provide sealing means between cover 33 and housing face 49 to keep substances being pumped by pump 10 in chamber 14.

Figure 18:
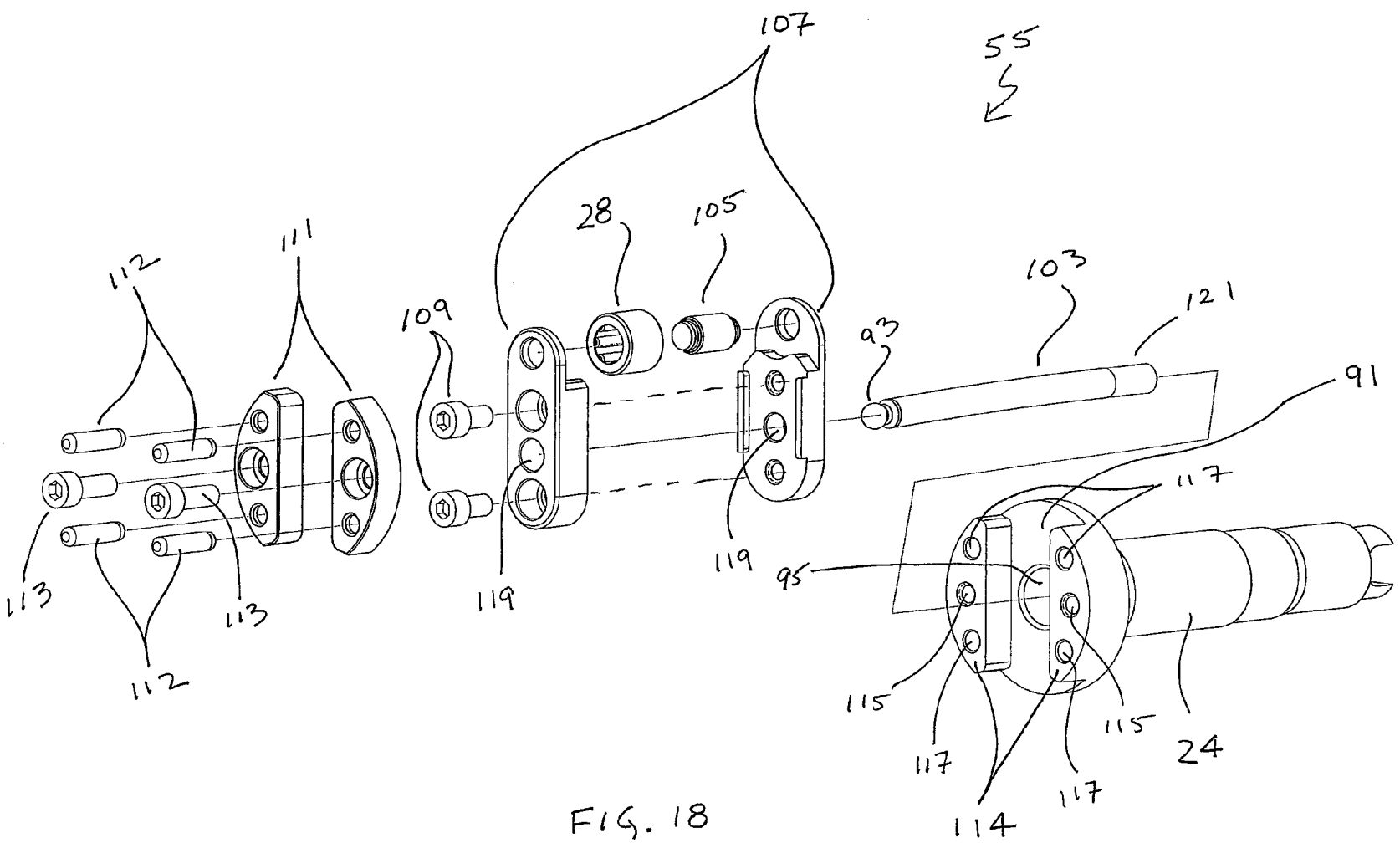
FIG. 18 is an exploded perspective view depicting the crankshaft of the oscillating ring pump of FIG. 17.
Figure 19:
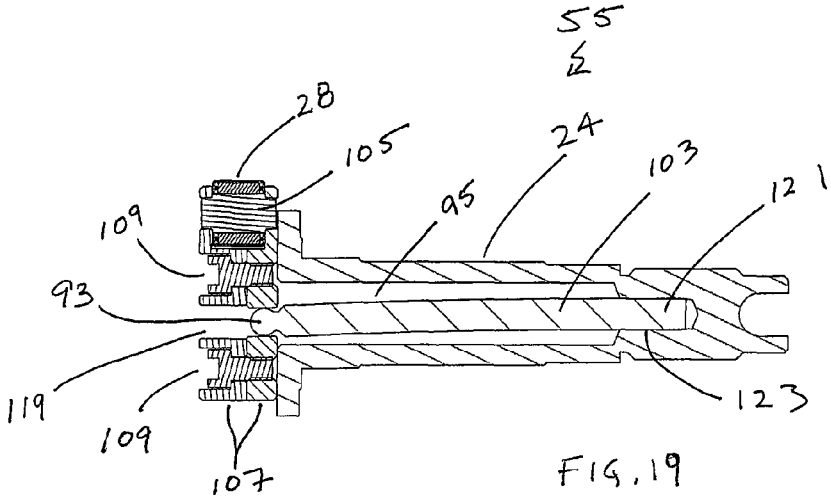
FIG. 19 is a side elevation cross-sectional view depicting the crankshaft of FIG. 18.
Figure 20:
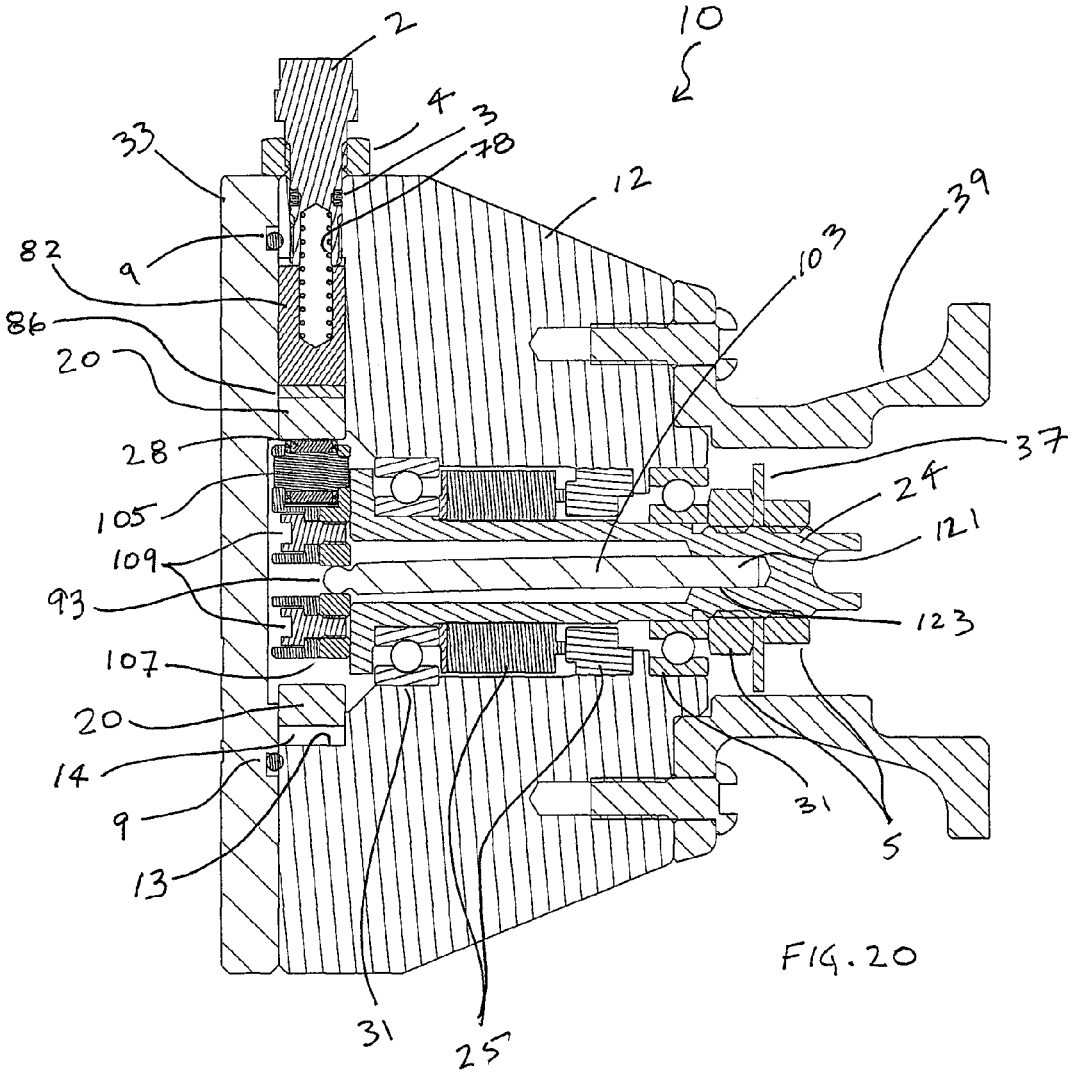
FIG. 20 is a side cross-sectional view depicting the oscillating ring pump of FIG. 16.

Referring to FIGS. 18 to 20, one embodiment of crank assembly 55 is illustrated. In some embodiments, crank assembly 55 can comprise crankshaft 24 having longitudinal opening 95 extending partially into crankshaft 24 from one end. Spring rod 103 can be inserted into opening 95, which can be further affixed to crankshaft 24 by rod end 121 being firmly seated in opening 123 disposed therein. In this configuration, spring rod 103 can be comprised of metal or other functionally equivalent material as well known to those skilled in the art such that spring rod 103 can function or operate as a cantilever spring.

In some embodiments, spring rod 103 can further comprise end 93 that can be configured to engage opening 119 disposed on sliding support 107. In some embodiments, sliding support 107 can comprise two halves that can be assembled together with fasteners 109 to support spacer pin 105 disposed between the two halves that can further comprise spacer 28 rotatably disposed thereon. It is obvious to those skilled in the art that sliding support 107 can be comprised of a singular or integral member configured to support spacer pin 105. When spring rod 103 is disposed within opening 95 and sliding support 107 is disposed on end 93, sliding support 107 can move linearly in channel 91 formed by offset faces 114 disposed on the end of crankshaft 24. In some embodiments, offset support guides 111 can be attached to offset faces 114 with dowel pins 112 extending into dowel holes 117 and fasteners 113 threaded into threaded openings 115 to further define channel 91. When crank assembly 55 is assembled and inserted into chamber 14 with ring 20, spring rod 103 can act as a bias mechanism to apply force to sliding support 107 and spacer 28 to bias or urge ring 20 towards sidewall 13. This can be seen in FIG. 20. The physical dimensions of slider support 107, spacer 28 and ring 20 can be selected such that spring rod 103 is deflected when these elements are disposed in chamber 14. In so doing, spring rod 103 can apply force via sliding support 107 and spacer 28 to ring 20 to maintain contact with sidewall 13 as pump 10 is operating.

In some embodiments, these elements can also function as a built-in pressure relief valve for pump 10. If the pressure of substances being pumped by pump 10 exceeds the pressure exerted on ring 20 by spring rod 103, spring rod 103 can then deflect such that ring 20 can move away from sidewall 13 thereby allowing the pressure of the pumped substances to equalize throughout chamber 14.

Figure 21:
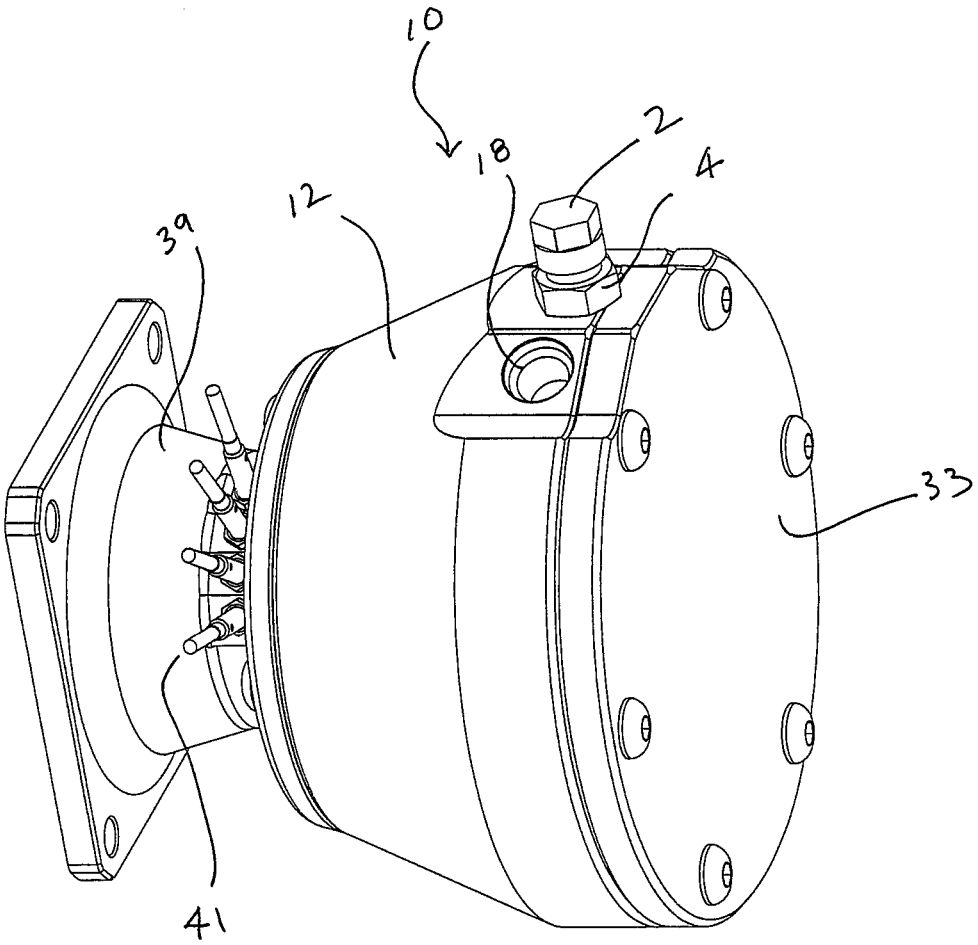
FIG. 21 is a perspective view depicting the oscillating ring pump of FIG. 16.

Referring to FIG. 21, a perspective view of pump 10 is shown. In this embodiment, pump 10 can comprise bracket housing 39 disposed on one thereof, bracket housing 39 further comprising a plurality of proximity sensors 41. In the illustrated embodiment, four proximity sensors 41 are shown although it is obvious to those skilled in the art that fewer or more proximity sensors 41 can be disposed on bracket housing 39.

Figure 22:
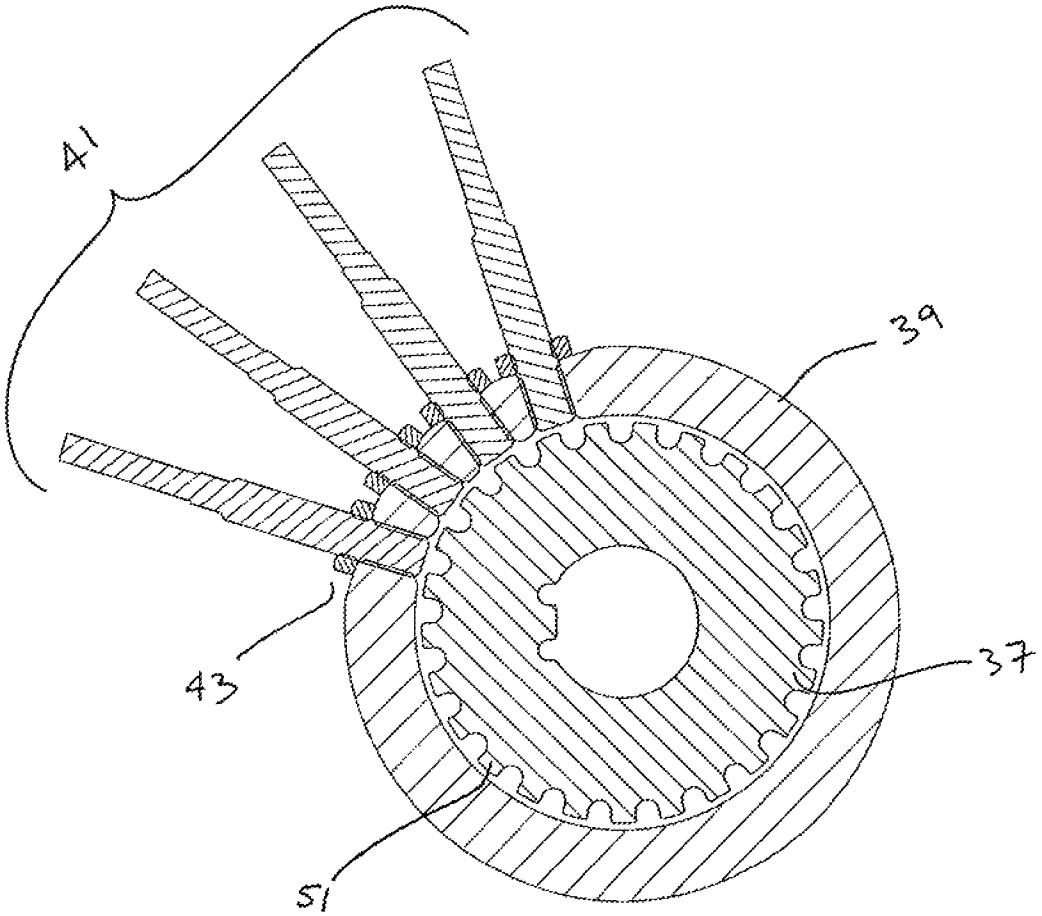
FIG. 22 is a front elevation cross-sectional view depicting the proximity sensors of the oscillating ring pump of FIG. 21.

Referring to FIG. 22, a cross-sectional view of bracket housing 39 is shown. In this embodiment, ring gear 37 (as attached to crankshaft 24 and as shown in FIG. 20) is shown disposed within bracket housing 39, ring gear 37 configured to rotate within bracket housing 39 as crankshaft 24 rotates. In some embodiments, ring gear 37 can comprise a plurality of ring gear teeth 51 that can operate in conjunction with proximity sensors 41 wherein a general purpose computer, a microprocessor, a microcontroller or other functionally equivalent as well known to those skilled in the art (not shown) operatively connected to proximity sensors 41 can determine the direction of rotation and rate of rotation of crankshaft 24 when pump 10 is operating. The information concerning the direction and rate of rotation can be used by those skilled in the art to determine the volume of substances being pumped through pump 10 having consideration to the physical dimensions and parameters of pump 10 including, but not limited to, the volume of chamber 14 and the size of ring 20.

Referring to FIGS. 23 to 26, operation of the embodiment of pump 10 shown in FIG. 16 is illustrated. For simplicity, these figures do not show include the check valves that would normally be disposed in inlet 16 and outlet 18. The operation of this embodiment of pump 10 is similar to other embodiments of pump 10, as described in detail above and as shown in the attached figures, save for the differences as discussed below.

Figure 23:
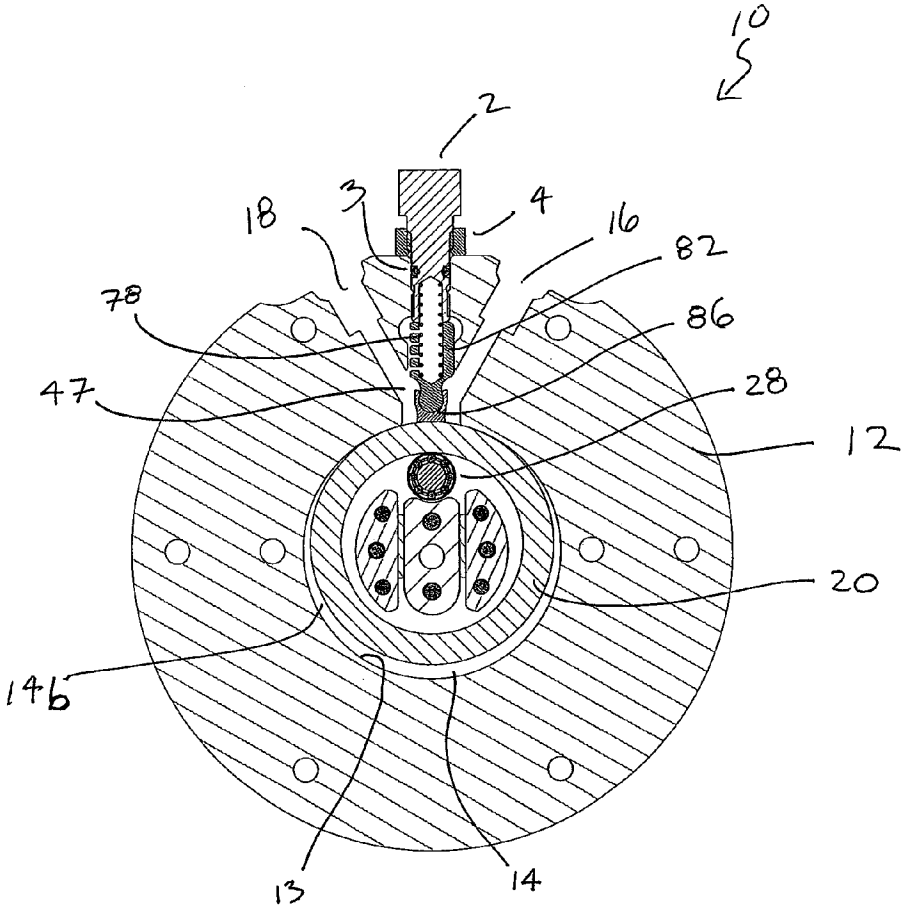
FIG. 23 is a front elevation cross-sectional view depicting the oscillating ring pump of FIG. 16 with the ring located near TDC.

In FIG. 23, pump 10 is shown with ring 20 at approximately TDC. In this position, ring 20 has compressed slider valve 82 upwards and sealed off valve chamber 47 wherein no substances can enter chamber 14 through inlet 16, or exit chamber 14 through outlet 18. For the purpose of these illustrations, substances are contained in pump chamber 14 in this initial condition. Pump 10 begins to operate when input rotational power is applied to crankshaft 24. The input rotational power is applied to an input shaft (not shown) operatively attached to crankshaft 24. The input rotational power can be obtained from any suitable source such as a motor or from rotating shafts that are operatively coupled to the input shaft, either by meshed gears, a belt and pulleys, a chain and sprockets or any other suitable means as well known to those skilled in the art. In the illustrated embodiment, crankshaft 24 can rotate clockwise as shown in chamber 14 thereby allowing slider valve 82 to move downward in valve chamber 47 and to open a communication path between chamber 14 and outlet 18. It should be obvious to one skilled in the art, however, that pump 10 can be assembled in a mirrored configuration whereupon crankshaft 24 can rotate in a counter clockwise direction.

Figure 24:
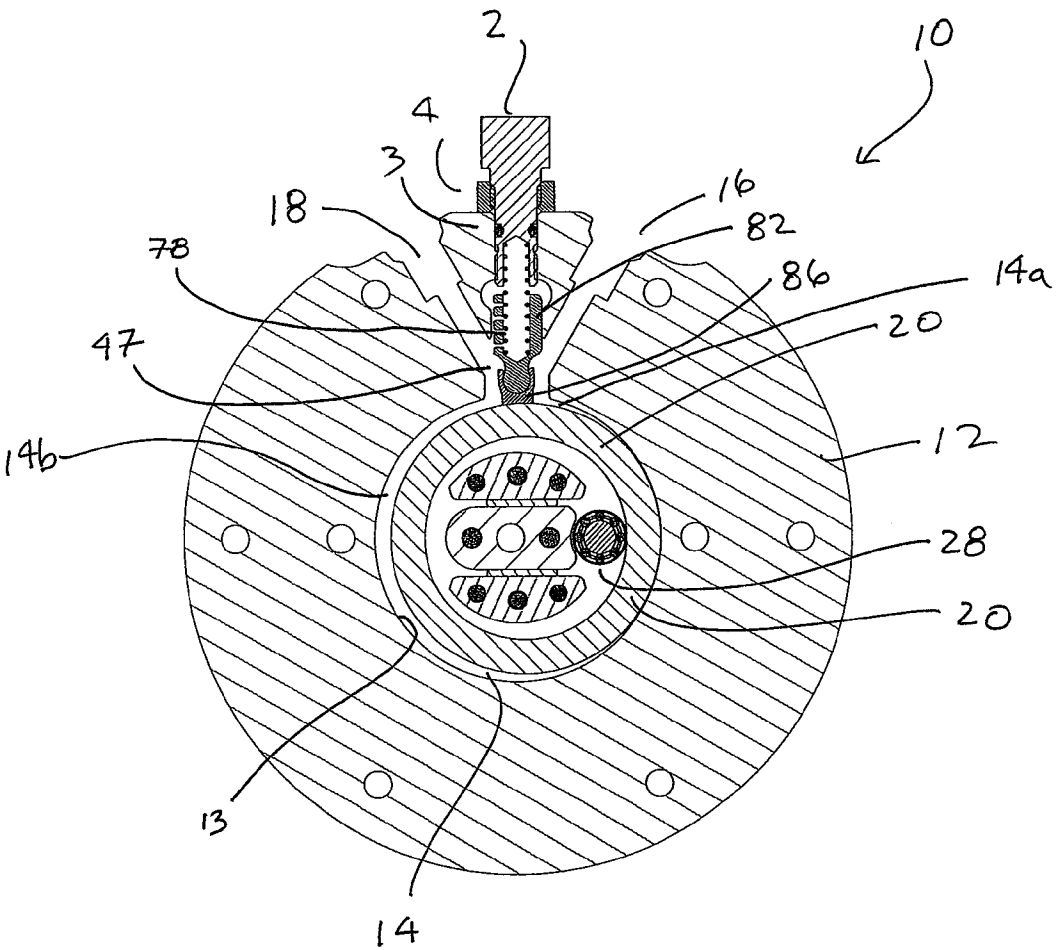
FIG. 24 is a front elevation cross-sectional view depicting the oscillating ring pump of FIG. 16 with the ring rotated about 90° clockwise from TDC.

Referring to FIG. 24, ring 20 is shown at approximately 90° rotated clockwise from TDC. In so doing, the movement of ring 20 divides chamber 14 into two parts: chamber 14*a*, which is formed between inlet 16 and where ring 20 contacts sidewall 13; and chamber 14*b*, which is formed between outlet 18 and where ring 20 contacts sidewall 13. In this position, ring 20 has moved away from valve chamber 47 and slider valve 82 has extended down somewhat to open a communication path between inlet 16 and chamber 14*a*, and a communication path between outlet 18 and chamber 14*b*. Slider valve 82 acts as a barrier between chambers 14*a* and 14*b* and to separate and isolate inlet 16 from outlet 18. Substances in chamber 14*b* are moved towards outlet 18 as ring 20 rotates clockwise, as shown in the figure, while simultaneously drawing in substances into chamber 14*a* through inlet 16 due the vacuum or negative pressure that forms within chamber 14*a* as it increases in volume when ring 20 rotates from TDC.

Figure 25:
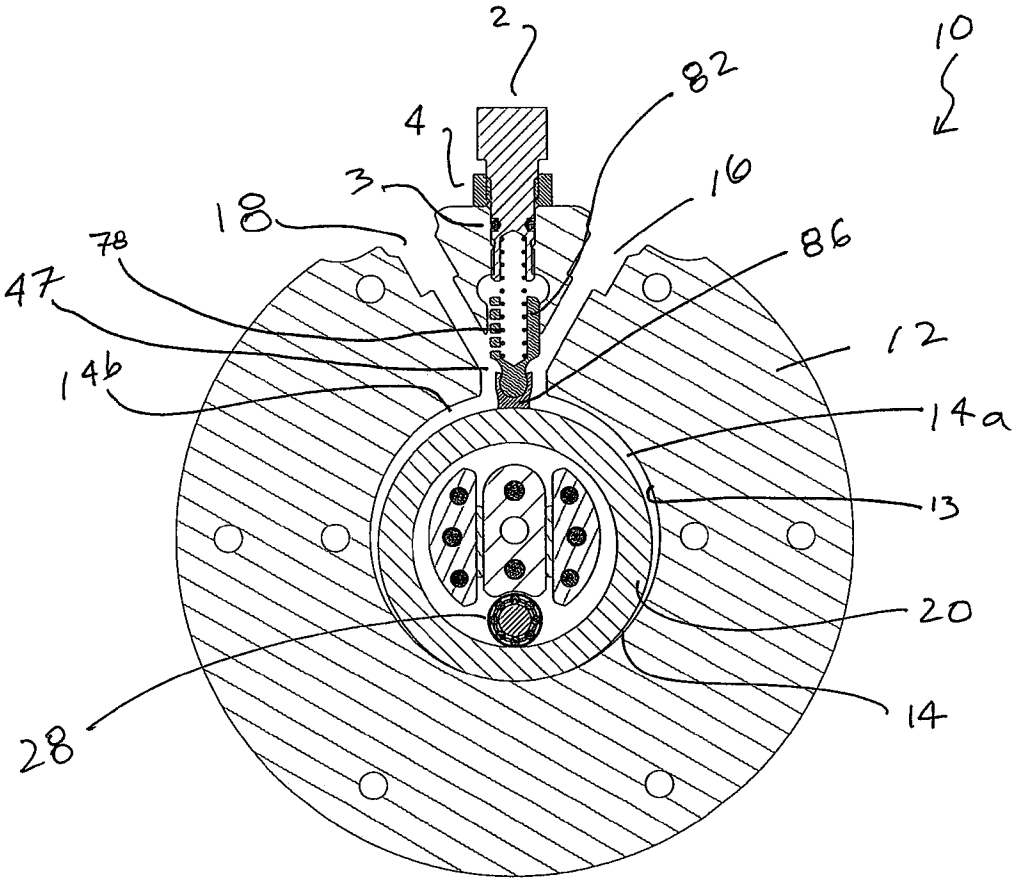
FIG. 25 is a front elevation cross-sectional view depicting the oscillating ring pump of FIG. 16 with the ring rotated about 180° clockwise from TDC.

Referring to FIG. 25, pump ring 20 is shown at approximately 180° rotated from TDC. In this position, pump chamber inlet side 14*a* is approximately the same volume as pump chamber outlet side 14*b*. As ring 20 continues to rotate clockwise, the volume of pump chamber outlet side 14*b* decreases thereby forcing substances through outlet port 18. Slider valve 82 and valve shoe 86 act as a barrier between chamber 14*a* and chamber 14*b*. As crankshaft 24 continues to rotate clockwise, pump chamber inlet side 14*a* increases in volume thereby drawing in more substances in through inlet 16.

Figure 26:
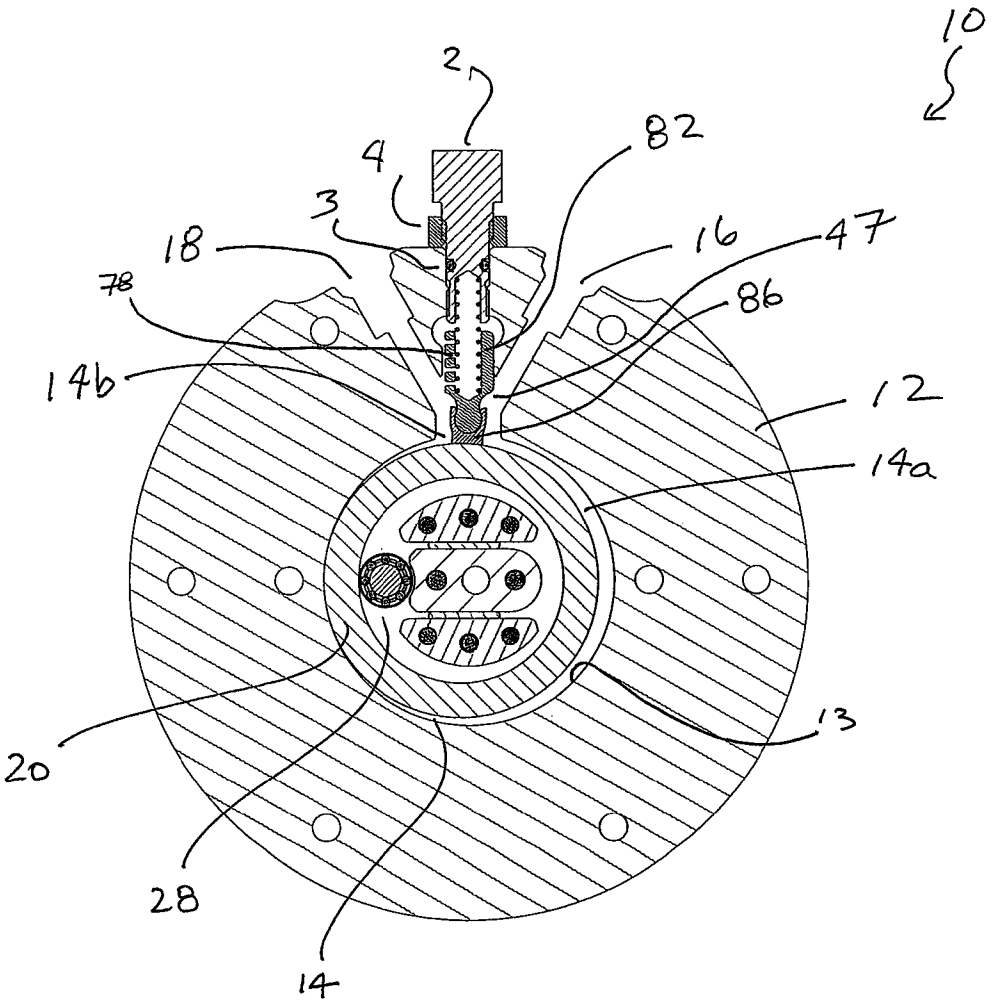
FIG. 26 is a front elevation cross-sectional view depicting the oscillating ring pump of FIG. 16 with the ring rotated about 270° clockwise from TDC.

Referring to FIG. 26, pump ring 20 is shown at approximately 270° rotated clockwise from TDC. In this position, the volume of chamber 14*b* has decreased and slider valve 22 has begun to retreat back into valve chamber 47. The volume of chamber 14*a* continues to increase to draw in more substances through chamber inlet 16.

As pump ring 20 continues to move clockwise back to TDC, the pumping process continues in the manner described whereby substances are drawn into and pumped out of pump chamber 14 simultaneously with each revolution of crankshaft 24. The volume of substances displaced by pump 10 in each revolution of crankshaft 24 is a function of the diameter of ring 20. As the diameter of ring 20 is increased, the amounts of substances drawn in and expelled by pump 10 decreases as the available volume chambers 14*a* and 14*b* has decreased. Similarly, as the diameter of ring 20 is decreased, the amounts of substances drawn in and expelled by pump 10 increases as the available volume for chambers 14*a* and 14*b* has increased.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A pump, comprising:

a) a housing comprising an exterior surface and an enclosed interior chamber with a sidewall, the chamber substantially circular in cross-section;

b) an inlet port providing communication between the exterior surface and the interior chamber;

c) an outlet port providing communication between the exterior surface and the interior chamber;

d) a rotatable crank assembly comprising a longitudinal axis rotatably disposed within said housing wherein the longitudinal axis is coaxially aligned with the center of the circular cross-section of the interior chamber;

e) a spacer support operatively connected to the crank assembly, the spacer support disposed within the interior chamber, the spacer support further comprising a spacer pin;

f) an annular spacer rotatably disposed on the spacer pin;

g) an annular ring disposed in the interior chamber, the annular ring further comprising a ring sidewall disposed between the annular spacer and the interior chamber sidewall, the ring sidewall having a width being the same as a minimum distance separating the annular spacer and the interior chamber sidewall; and h) a slider valve slidably disposed in the housing, the slider valve configured to maintain contact with the ring as the crank assembly is rotating thereby isolating the inlet port from the outlet port.

2. The pump as set forth in claim 1, wherein the housing further comprises a valve guide opening for slidably receiving the slider valve.

3. The pump as set forth in claim 2, wherein the slider valve and the valve guide opening are disposed at an angle with respect to the exterior surface of the housing.

4. The pump as set forth in claim 1, further comprising first biasing means for urging the slider valve to maintain contact with the annular ring as the crankshaft is rotating.

5. The pump as set forth in claim 4, wherein the first biasing means further comprises a spring.

6. The pump as set forth in claim 1, wherein the spacer support further comprises second biasing means for urging the annular spacer towards the annular ring.

7. The pump as set forth in claim 6, wherein the second biasing means comprises a cantilever spring.

8. The pump as set forth in claim 1, wherein the crank assembly further comprises one or more support guides for guiding the movement of the spacer support.

9. The pump as set forth in claim 1 wherein the slider valve further comprises a pivoting shoe for maintaining contact with the annular ring.

10. The pump as set forth in claim 1 wherein either or both of the inlet and outlet ports comprise a check valve.

11. The pump as set forth in claim 1 further comprising means for regulating the pressure of fluids being pumped.

12. The pump as set forth in claim 11 wherein the regulating means further comprises:

a) a passageway providing communication between the outlet and inlet ports; and b) regulating valve means for controlling the amount of pumped fluids that flow from the outlet port to the inlet port through the passageway.

13. The pump as set forth in claim 12 wherein the regulating valve means further comprises a check valve.

14. The pump as set forth in claim 1 further comprising at least one additional annular ring having a different diameter as part of a kit for the pump for adjusting the amount of substances that are deliverable by the pump.

15. The pump as set forth in claim 1 wherein the housing further comprises a removable cover to provide access to the interior chamber.

* * * * *